US009441510B2

(12) United States Patent
Noda et al.

(10) Patent No.: US 9,441,510 B2
(45) Date of Patent: Sep. 13, 2016

(54) VALVE SYSTEM FOR A MULTI-CYLINDER ENGINE

(71) Applicant: MAZDA MOTOR CORPORATION, Hiroshima (JP)

(72) Inventors: Akihiro Noda, Hatsukaichi (JP); Shigeki Komatsu, Hiroshima (JP); Yukio Misaki, Hiroshima (JP)

(73) Assignee: MAZDA MOTOR CORPORATION, Hiroshima (JP)

( * ) Notice: Subject to any disclaimer, the term of this patent is extended or adjusted under 35 U.S.C. 154(b) by 0 days.

(21) Appl. No.: 14/655,700

(22) PCT Filed: May 2, 2014

(86) PCT No.: PCT/JP2014/062166

§ 371 (c)(1),
(2) Date: Jun. 25, 2015

(87) PCT Pub. No.: WO2014/185295

PCT Pub. Date: Nov. 20, 2014

(65) Prior Publication Data

US 2015/0330270 A1 Nov. 19, 2015

(30) Foreign Application Priority Data

May 17, 2013 (JP) ..... 2013-105190

(51) Int. Cl.
*F01L 1/08* (2006.01)
*F01L 13/00* (2006.01)
(Continued)

(52) U.S. Cl.
CPC ..... *F01L 13/0036* (2013.01); *F01L 1/08* (2013.01); *F01L 1/047* (2013.01); *F01L 1/185* (2013.01); *F01L 13/0042* (2013.01); *F01L 2001/0535* (2013.01); *F01L 2013/0052* (2013.01); *F01L 2013/0078* (2013.01); *F01L 2105/00* (2013.01)

(58) Field of Classification Search
CPC ..... F01L 1/08; F01L 2001/0473; F01L 2001/0475; F01L 2001/0535; F01L 13/0036; F01L 13/0042; F01L 2013/0052; F01L 2013/0078
USPC ..... 123/90.15, 90.16, 90.17, 90.18, 90.2, 123/90.27
See application file for complete search history.

(56) References Cited

U.S. PATENT DOCUMENTS 4,512,154 A * 4/1985 Ueno ..... F01B 29/04 123/198 F
8,365,692 B2 * 2/2013 Schoeneberg ..... F01L 1/047 123/90.15

(Continued)

FOREIGN PATENT DOCUMENTS

DE 10148177 A1 4/2003
JP 2009-228543 A 10/2009

(Continued)

OTHER PUBLICATIONS

An Office Action issued by the German Patent Office on Nov. 13, 2015, which corresponds to German Patent Application No. 11 2014 000 360.3 and is related to U.S. Appl. No. 14/655,700.

(Continued)

*Primary Examiner* — Jorge Leon, Jr.
(74) *Attorney, Agent, or Firm* — Studebaker & Brackett PC

(57) ABSTRACT

A valve system includes: a cam shaft including a shaft section and a plurality of cam element sections; and a plurality of operation members that moves the cam element sections in an axial direction. The plurality of operation members include a common operation member that is provided in common between end face cams opposed to each other of the cam element sections of two cylinders disposed adjacent to each other and continuous in ignition order and that engages with the respective end face cams when both the cam element sections are close to each other, and individual operation members that are individually provided for end face cams opposed to each other of the cam element sections of two cylinders disposed adjacent to each other and discontinuous in ignition order and end face cams located at opposite ends of a cylinder row and that engage with the respective end face cams.

4 Claims, 17 Drawing Sheets

(51) Int. Cl.

| | |
|---|---|
| *F01L 1/047* | (2006.01) |
| *F01L 1/053* | (2006.01) |
| *F01L 1/18* | (2006.01) |

(56) References Cited

U.S. PATENT DOCUMENTS

| | | | |
|---|---|---|---|
| 2010/0269769 | A1 | 10/2010 | Schoeneberg et al. |
| 2011/0226205 | A1 | 9/2011 | Kraus |

FOREIGN PATENT DOCUMENTS

| | | | |
|---|---|---|---|
| JP | 2010-520395 | A | 6/2010 |
| JP | 2011-122498 | A | 6/2011 |
| JP | 2013-83202 | A | 5/2013 |
| JP | 2013-083255 | A | 5/2013 |

OTHER PUBLICATIONS

International Search Report; PCT/JP2014/062166; Jul. 8, 2014.

* cited by examiner

VALVE SYSTEM FOR A MULTI-CYLINDER ENGINE

TECHNICAL FIELD

The present invention relates to a valve system for a multi-cylinder engine for a vehicle or the like and, more particularly, to a valve system capable of switching a cam for opening and closing a valve, and belongs to a technical field of a valve system for an engine.

BACKGROUND ART

As a valve system for a multi-cylinder engine, there is known a valve system that includes, for one valve of each cylinder, a plurality of cams having different shapes of nose sections and selects a cam for opening and closing the valve out of the cams to make it possible to switch valve opening amounts, valve opening and closing periods, and the like of intake and exhaust valves according to an operation state of the engine.

For example, Patent Literature 1 discloses a valve system including a cam shaft including a shaft section and a cylindrical cam element section movably spline-fitted on the shaft section in an axial direction. In the valve system, on the outer circumference of the cam element section, a plurality of adjacent cams having different shapes of nose sections are provided for one valve. The valve system moves the cam element section in the axial direction to thereby switch a cam that opens and closes the valve.

Specifically, in the valve system disclosed in Patent Literature 1, a plurality of cam element sections are provided to correspond to cylinders of a multi-cylinder engine. End face cams are formed on both end faces of the cam element section. The valve system disclosed in the literature includes operation members retractably provided with respect to opposing positions of the end face cams. The operation members are driven by an actuator to project and engage with the end face cams when projecting. Consequently, the cam element section is moved in the axial direction and the cam is switched.

Incidentally, in the valve system disclosed in Patent Literature 1, the end face cams are provided on both the end faces of the cam element section in order to move the cam element section to both sides in the axial direction of the shaft section. The valve system includes the operation member for each of the end face cams on both the sides. Therefore, two operation members are necessary for one cam element section. The number of components increases.

As measures against this problem, in order to reduce the number of components of the operation members, it is conceivable to adopt a method of disposing a single operation member between cylinders adjacent to each other, projecting the operation member to between opposed end face cams of two cam element sections disposed closer to each other, and engaging the operation member with the respective end face cams to thereby separate both the cam element sections in the axial direction and switch a cam.

However, with this method, there is a problem in that, between two cylinders disposed adjacent to each other and discontinuous in ignition order, a period in which the operation member can be projected to between the opposed end face cams decreases and, in particular, during high-speed rotation of an engine, it is difficult to switch the cam. A reason why the period in which the operation member can be projected decreases is explained below using a four-cylinder engine as an example.

For example, in a four-cylinder engine in which first, second, third, and fourth cylinders are disposed in this order, when ignition order is the order of the third cylinder, the fourth cylinder, the second cylinder, and the first cylinder, the second and third cylinders are adjacent to each other but are discontinuous in the ignition order. In order to move a cam element section while a valve is closed, lift sections of end face cams are disposed to overlap a projecting position of an operation member (overlap the operation member after projection in axial direction view) when nose sections do not open and close the valve. That is, both of the lift sections and reference planes (parts that are not the lift sections) of the end face cams are set on the basis of phases of the nose sections.

Since the second and third cylinders are discontinuous in the ignition order, the phases of the nose sections of two end face cams opposed between these cylinders are not in a continuous relation. As a result, an angle range in which two reference planes of the two end face cams overlap is divided into two ranges, which are respectively narrow angle ranges.

Incidentally, between the cylinders adjacent to each other, timing when the operation members can be projected is limited to time when each of the reference planes of the opposed two end face cams overlaps the projecting position of the operation member. On the other hand, as explained above, when the adjacent cylinders are discontinuous in the ignition order, compared with when the cylinders are continuous in the ignition order, an angle range in which the two reference planes overlap is narrow. Therefore, between the cylinders discontinuous in the ignition order, a period in which the operation member can be projected is short.

Moreover, during high-speed rotation of the engine, since rotating speed of a cam shaft is high, the period in which the operation member can be projected is shorter. As a result, depending on projection speed of the operation member, even if it is attempted to project the operation member to between the two reference planes, the projection is late. It is difficult to switch a cam section.

CITATION LIST

Patent Literature

Patent Literature 1: United States Patent Publication No. 2011/0226205A1

SUMMARY OF INVENTION

The present invention has been devised in order to solve the problems and it is an object of the present invention to obtain, while reducing the number of components to attain compactness of an engine, a valve system for the engine capable of easily performing switching operation for cams during high-speed rotation of the engine.

In order to solve the problems, the present invention relates to a valve system provided in a multi-cylinder engine including at least a pair of cylinders disposed adjacent to each other and discontinuous in ignition order and at least a pair of cylinders disposed adjacent to each other and continuous in ignition order. The valve system includes: a cam shaft including a shaft section extending in a cylinder row direction and a plurality of cam element sections provided respectively in the cylinders and fit in the shaft section to be capable of rotating integrally with the shaft section and moving in an axial direction; and an operation mechanism that moves the plurality of cam element sections in the axial direction with respect to the shaft section. Each of the cam element sections includes, for each one valve of the cylinders, two cam sections which include a common base circle, have differently shaped nose sections, and adjacent to each other in the axial direction. End face cams are respectively provided at both end portions in the axial direction of each of the cam element sections. The operation mechanism includes a plurality of operation members driven by an actuator to be movable between an actuation position where the operation members rush into positions opposed to the end face cams of the plurality of cam element sections in the axial direction and a retracting position where the operation members retract from opposing positions of the end face cams, wherein the operation mechanism engages the operation members, which have moved to the actuation position, with the end face cams and moves the cam element sections in the axial direction to thereby switch the cam section that opens and closes valves of the cylinders. The plurality of operation members include: a common operation member that is provided in common between the end face cams opposed to each other of the cam element sections of two cylinders disposed adjacent to each other and continuous in ignition order and that engages with the respective end face cams when both the cam element sections are close to each other; and individual operation members that are individually provided for the end face cams opposed to each other of the cam element sections of two cylinders disposed adjacent to each other and discontinuous in ignition order and the end face cams located at opposite ends of the cylinder row and that engage with the respective end face cams.

With the valve system for the multi-cylinder engine according to the present invention, it is possible to easily perform the switching operation for the cams during the high-speed rotation of the engine while reducing the number of components to attain compactness of the engine.

DESCRIPTION OF EMBODIMENTS (First Embodiment)

A first embodiment of the present invention is explained below using, as an example, a valve system of a four-cylinder four-valve DOHC engine in which two intake valves and two exhaust valves are provided for one cylinder.

Figure 1:
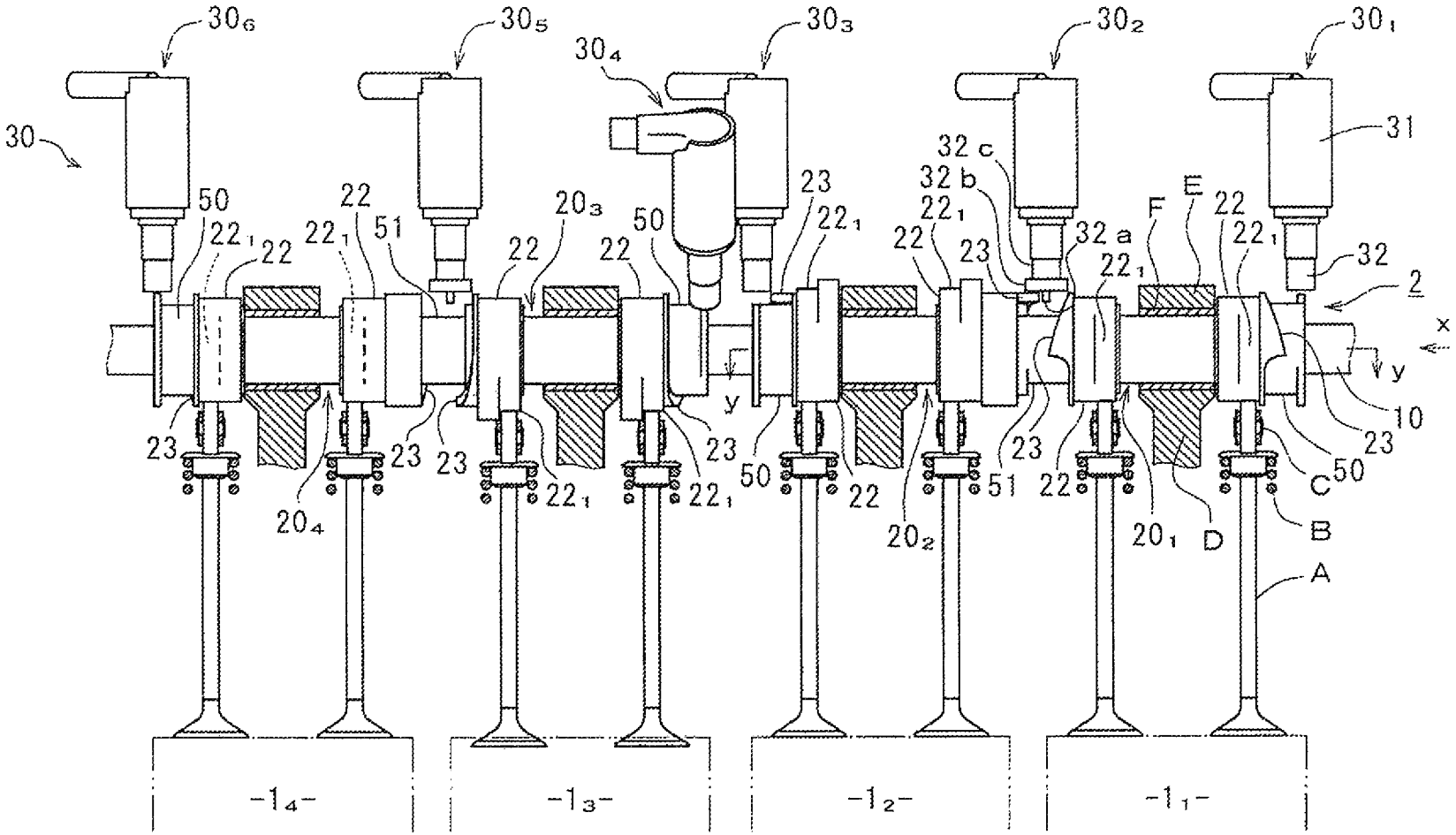
FIG. 1 is a side view showing the schematic configuration of an exhaust-side valve system according to a first embodiment of the present invention.

FIG. 1 shows the configuration on an exhaust side of a valve system according to the first embodiment. A not-shown cylinder head includes eight exhaust valves A . . . A in total, two each for each of first to fourth cylinders $\mathbf{1}_1$ to $\mathbf{1}_4$, and return springs B . . . B that urge the exhaust valves A . . . A in a closing direction. The valve system includes a cam shaft 2 provided in an upper part of the cylinder head as a shaft for opening and closing the exhaust valves A . . . A and an operation mechanism 30 provided above the cam shaft 2.

The cam shaft 2 presses the exhaust valves A . . . A via rocker arms C . . . C to thereby open and close the exhaust valves A . . . A resisting urging force of the return springs B . . . B. The cam shaft 2 is rotatably supported by bearing sections F . . . F including vertical wall sections D . . . D provided in respective center positions of the cylinders $\mathbf{1}_1$ to $\mathbf{1}_4$ in the cylinder head and cap members E . . . E attached to upper parts of the vertical wall sections D . . . D. The cam shaft 2 is driven to rotate by a not-shown crankshaft via a chain.

The cam shaft 2 includes a shaft section 10 and first to fourth cam element sections $\mathbf{20}_1$ to $\mathbf{20}_4$ spline-fit in the shaft section 10 and capable of rotating integrally with the shaft section 10 and moving in an axial direction. The cam element sections $\mathbf{20}_1$ to $\mathbf{20}_4$ are disposed in a row on the shaft section 10 to correspond to the cylinders $\mathbf{1}_1$ to $\mathbf{1}_4$.

The operation mechanism 30 includes six operation devices $\mathbf{30}_1$ to $\mathbf{30}_6$ of an electromagnetic type that move the cam element sections $\mathbf{20}_1$ to $\mathbf{20}_4$ along the shaft section 10.

With the side of the first cylinder $1_1$ located on one side of the cylinder row set as the front, in order from the front, the first operation device $30_1$ is disposed in a front end position of the cylinder row, the second operation device $30_2$ is disposed in a position between the first and second cylinders $1_1$, $1_2$, the third and fourth operation devices $30_3$, $30_4$ are disposed in a position between the second and third cylinders $1_2$, $1_3$, the fifth operation device $30_5$ is disposed in a position between the third and fourth cylinders $1_3$, $1_4$, and the sixth operation device $30_6$ is disposed in a rear end position of the cylinder row.

Figure 2:
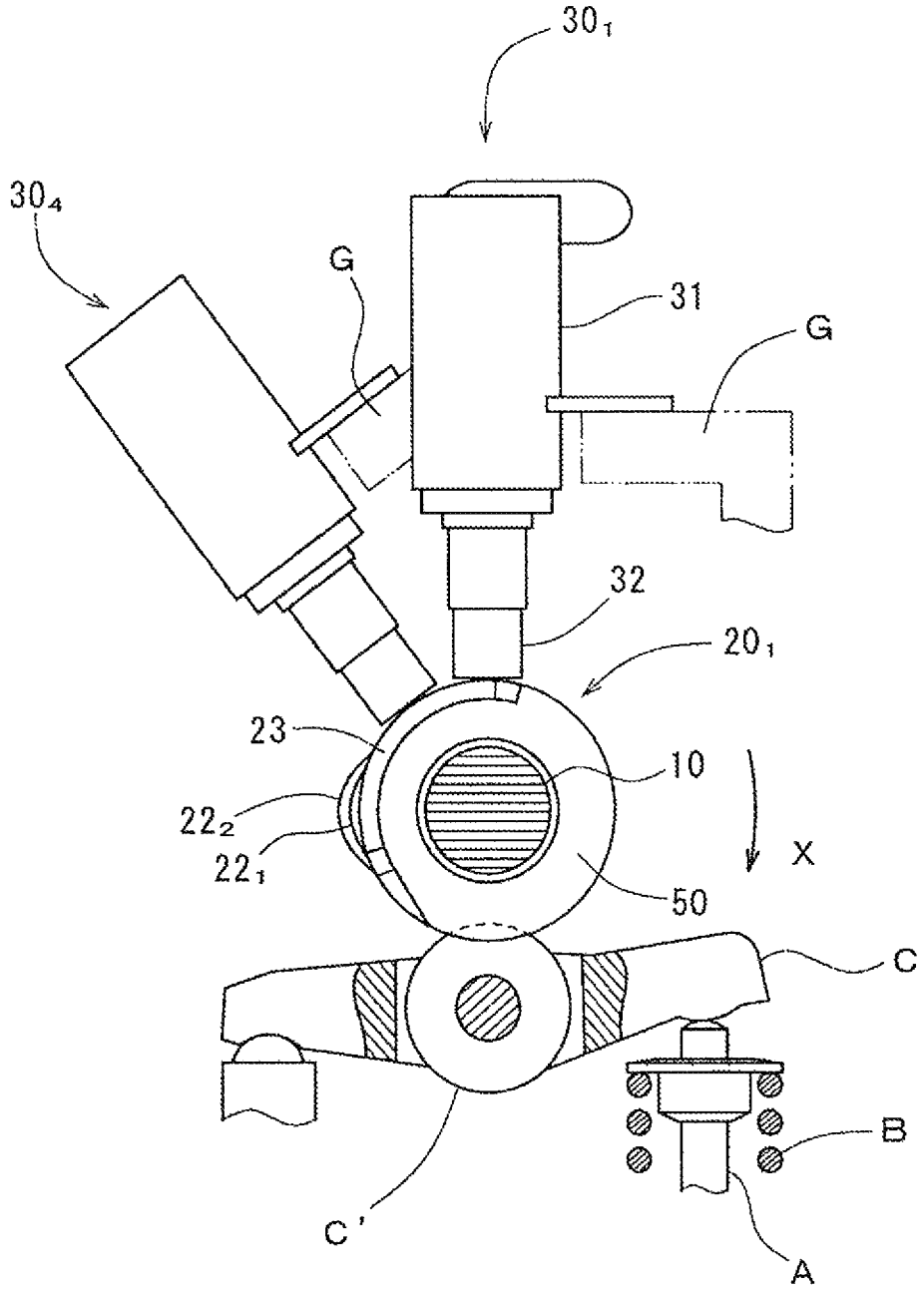
FIG. 2 is a front view of the valve system in an x-direction arrow view in FIG. 1.

The operation devices $30_1$ to $30_6$ of the operation mechanism 30 include main bodies 31 incorporating electromagnetic actuators and pin sections 32 functioning as operation members that move, with energization to the electromagnetic actuators, from a retracting position where the pin sections 32 retract in the main bodies 31 to an actuation position where the pin sections 32 project from the main bodies 31. As shown in FIG. 2, the first operation device $30_1$ (the second, third, fifth, and sixth operation devices $30_2$, $30_3$, $30_5$, and $30_6$ as well) is disposed on substantially the opposite side of a cam follower C' in the rocker arm C across the cam shaft 2. The fourth operation device $30_4$ is disposed on the near side in the rotating direction X at a predetermined angle (e.g., about 30°) with respect to the other operation devices.

The operation devices $30_1$ to $30_6$ are respectively disposed such that the pin sections 32 are directed to the axis of the cam shaft 2. In the case of this embodiment, the operation devices $30_1$ to $30_6$ are respectively attached to pedestal sections G . . . G integrally formed in cap members E . . . E of the bearing sections F . . . F.

As shown in FIG. 1, the pin sections 32 of the first, third, fourth, and sixth operation devices $30_1$, $30_3$, $30_4$, and $30_6$ are formed in a cylindrical shape. On the other hand, the pin sections 32 of the second and fifth operation devices $30_2$, $30_5$ are formed in a stepped shape and include small-diameter sections 32*a*, large-diameter sections 32*b*, and medium-diameter sections 32*c* in order from the distal end side.

Figure 3:
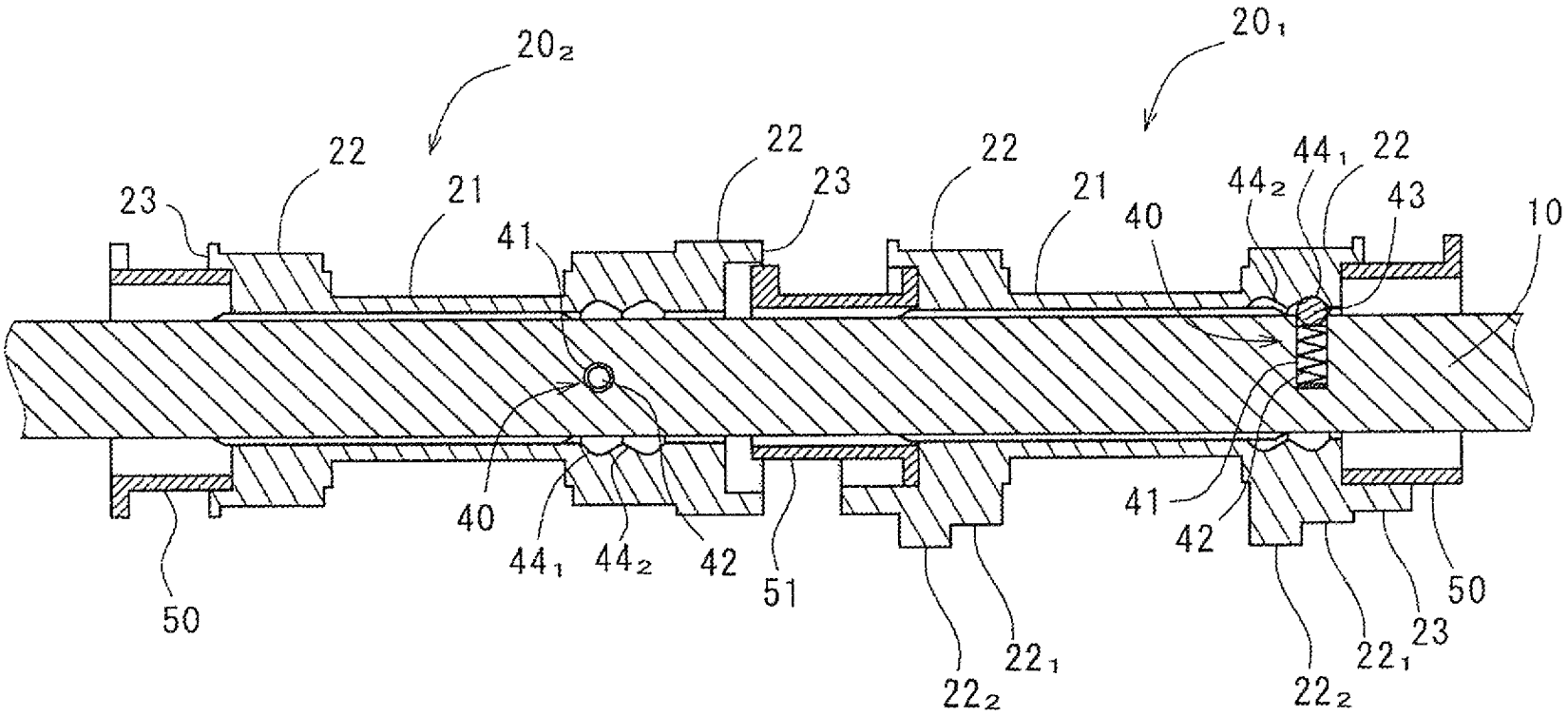
FIG. 3 is an enlarged sectional view taken along line y-y in FIG. 1.

In order to determine, in predetermined two places, positions in the axial direction of the cam element sections $20_1$ to $20_4$ moved by the operation devices $30_1$ to $30_6$, as shown in FIG. 3 using the first and second cam element sections $20_1$, $20_2$ as an example, detent mechanisms 40 are respectively provided in fitting sections of the shaft section 10 and the cam element sections $20_1$ to $20_4$.

The detent mechanism 40 includes a hole 41 drilled in the radial direction from the outer circumferential surface of the shaft section 10, a spring 42 housed in the hole 41, a detent ball 43 disposed in an opening section of the hole 41 and urged to jump out from the outer circumferential surface of the shaft section 10 to the outer side in the radial direction by the spring 42, and circumferential grooves $44_1$, $44_2$ provided in two places adjacent to each other in the axial direction on the inner circumferential surfaces of each of the cam element sections $20_1$ to $20_4$. When the detent ball 43 engages with one circumferential groove $44_1$, the cam element sections $20_1$ to $20_4$ are positioned in the first position shown in FIG. 1. When the detent ball 43 engages with the other circumferential groove $44_2$, the cam element sections $20_1$ to $20_4$ are positioned in the second position shown in FIG. 4.

As shown in FIG. 1, when all of the first to fourth cam element sections $20_1$ to $20_4$ are present in the first position, the first cam element section $20_1$ is disposed in the rear, the second cam element section $20_2$ is disposed in the front, the third cam element section $20_3$ is disposed in the rear, and the fourth cam element section $20_4$ is disposed in the front. Therefore, opposed end faces of the first and second cam element sections $20_1$, $20_2$ are close to each other, opposed end faces of the second and third cam element sections $20_2$, $20_3$ are separated from each other, and opposed end faces of the third and fourth cam element sections $20_3$, $20_4$ are close to each other.

Figure 4:
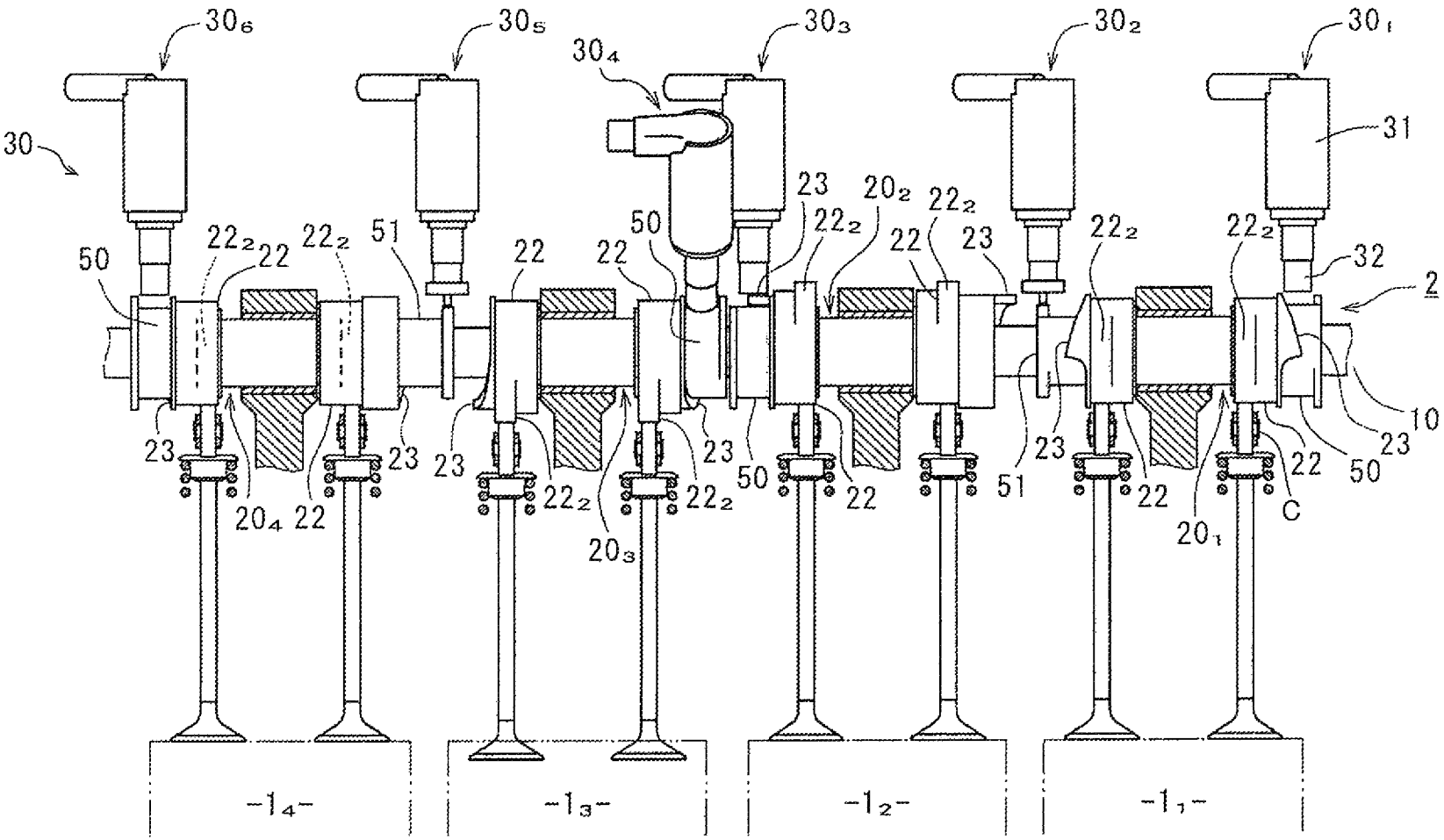
FIG. 4 is a side view showing a state in which a cam section that opens and closes a valve is switched from a state of FIG. 1.

As shown in FIG. 4, when all of the first to fourth cam element sections $20_1$ to $20_4$ are present in the second position, the first cam element section $20_1$ is located in the front, the second cam element section $20_2$ is located in the rear, the third cam element section $20_3$ is located in the front, and the fourth cam element section $20_4$ is located in the rear. Therefore, the opposed end faces of the first and second cam element sections $20_1$, $20_2$ are separated from each other, the opposed end faces of the second and third cam element sections $20_2$, $20_3$ are close to each other, and the opposed end faces of the third and fourth cam element sections $20_3$, $20_4$ are separated from each other.

Next, the configuration of the cam element sections $20_1$ to $20_4$ is explained more in detail using the first cam element $20_1$ as an example with reference to FIG. 5 to FIG. 8.

The cam element section $20_1$ ($20_2$ to $20_4$) is formed in a cylindrical shape. The outer circumferential surface in the intermediate section of the cam element section $20_1$ is formed as a journal section 21 supported by the bearing section E Actuating sections 22, 22 for the two exhaust valves A, A of the cylinder are provided on both the front and rear sides of the journal section 21. In the actuating sections 22, 22, a first cam section $22_1$ having a small lift amount for, for example, low-speed engine rotation time and a second cam section $22_2$ with a large lift amount for, for example, high-speed engine rotation time are provided adjacent to each other.

Figure 7:
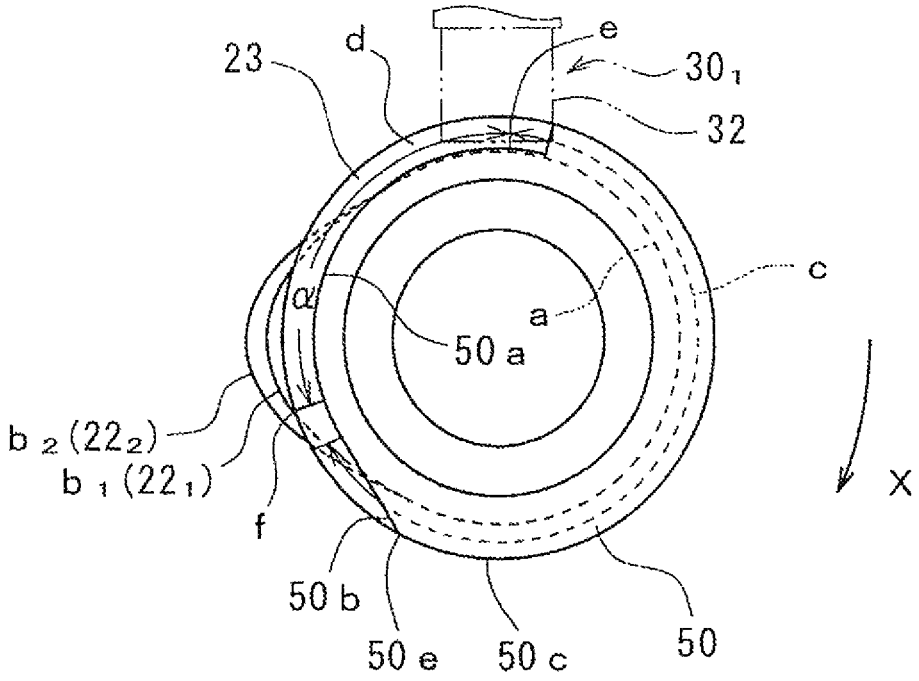
FIG. 7 is a front view of a cam element section in a z-direction arrow view in FIG. 6.
Figure 8:
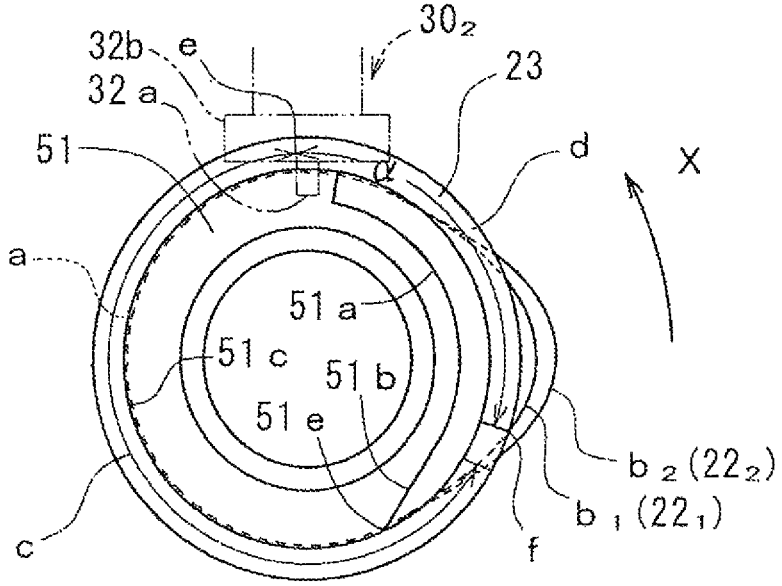
FIG. 8 is a rear view of the cam element section in a w-direction arrow view in FIG. 6.

As shown in FIG. 7 and FIG. 8, the first cam section $22_1$ and the second cam section $22_2$ respectively include nose sections $b_1$, $b_2$ having different lift amounts. The nose sections $b_1$, $b_2$ are provided on a common base circle a with phases thereof aligned. The first cam section $22_1$ and the second cam section $22_2$ are respectively provided with order of arrangement in the front-rear direction and phases of the nose sections $b_1$, $b_2$ matched in the actuating sections 22, 22 in the two places. Note that the common base circle a means that base circle diameters of base circles a of the first cam section $22_1$ and the second cam section $22_2$ are the same.

As shown in FIG. 1 and FIG. 4, in the first cam element section $20_1$ and the third cam element section $20_3$, the first cam section $22_1$ is disposed in the front and the second cam section $22_2$ is disposed in the rear. In the second cam element section $20_2$ and the fourth cam element section $20_4$, the second cam section $22_2$ is disposed in the front and the first cam section $22_1$ is disposed in the rear.

When the cam element sections $20_1$ to $20_4$ are positioned in the first position on the shaft section 10 by the detent mechanism 40, as shown in FIG. 1, in all the cam element sections $20_1$ to $20_4$, the two first cam sections $22_1$, $22_1$ are set to be located to correspond to the cam followers C', C' (see FIG. 2) of the two rocker arms C, C of the corresponding cylinder. When the cam element sections $20_1$ to $20_4$ are positioned in the second position on the shaft section 10, as shown in FIG. 4, the second cam sections $22_2$, $22_2$ are set to be located to correspond to the cam followers C', C'.

In the engine according to this embodiment, ignition order (combustion order) of the cylinders is set as the third cylinder $1_3$→the fourth cylinder $1_4$→the second cylinder $1_2$→the first cylinder $1_1$. Therefore, the first to fourth cam element sections $20_1$ to $20_4$ are spline-fit in the shaft section 10 with a phase difference of 90° from each other such that the nose sections $b_1$, $b_2$ of the first cam section $22_1$ or the second cam section $22_2$ of each of the cam element sections $20_1$ to $20_4$ press the cam followers C', C' of the cylinders in order according to the ignition order every time the cam shaft 2 rotates 90°.

Further, end face cams 23, 23 are respectively provided at both front and rear end portions (both end portions in the axial direction) of the cam element sections $20_1$ to $20_4$.

Each of the end face cams 23, 23 at both the front and rear end portions includes, as shown in FIG. 5 to FIG. 8, a reference plane c formed along a surface orthogonal to the axis of the cam element section $20_1$ ($20_2$ to $20_4$) and lift sections d symmetrically projecting to the front or the rear in the axial direction from the reference plane c. As shown in FIG. 7 and FIG. 8, the lift sections d are formed such that a lift amount in the axial direction from the reference plane c (lift amount zero) gradually increases in a predetermined angle range α (e.g., about 120°) from a lift start position e to a lift end position f. Specifically, the lift amount of the lift sections d is set to be larger on the forward side in a rotating direction X of the cam shaft 2 in the predetermined angle range α and return to zero in the lift end position f.

As explained above, the cam element sections $20_1$ to $20_4$ are spline-fit in the shaft section 10 with the predetermined phase difference from each other according to the ignition order of the cylinders $1_1$ to $1_4$. Accordingly, the end face cams 23, 23 opposed to each other of the cam element sections $20_1$ to $20_4$ are also opposed having a phase difference from each other.

The pin section 32 of the second operation device $30_2$ is equivalent to a "common operation member" in claims. The pin section 32 is disposed between the end face cams 23, 23 opposed to each other of the cam element sections $20_1$, $20_2$ of the first cylinder $1_1$ and the second cylinder $1_2$ disposed adjacent to each other and continuous in ignition order. The pin section 32 of the second operation device $30_2$ moves (projects) to the actuation position when the cam element sections $20_1$, $20_2$ are present in the first position to thereby move the cam element sections $20_1$, $20_2$ to the second position.

The pin section 32 of the fifth operation device $30_5$ is equivalent to the "common operation member" in claims. The pin section 32 is disposed between the end face cams 23, 23 opposed to each other of the cam element sections $20_3$, $20_4$ of the third cylinder $1_3$ and the fourth cylinder $1_4$ disposed adjacent to each other and continuous in ignition order. The pin section 32 of the fifth operation device $30_5$ moves (projects) to the actuation position when the cam element sections $20_3$, $20_4$ are present in the first position to thereby move the cam element sections $20_3$, $20_4$ to the second position.

Specifically, the pin section 32 of the second operation device $30_2$ or the fifth operation device $30_5$ moves to the actuation position when the two cam element sections corresponding to the pin section 32 are in a state (the first position) in which the two cam element sections are close to each other and the reference planes c of the end face cams 23, 23 opposed to each other of both the cam element sections are respectively in positions where the reference planes c overlap a projecting position of the pin section 32 (overlap the pin section 32 after the projection in axial direction view). The pin section 32 moved to the actuation position engages with the end face cams 23, 23 in order according to the rotation of the cam shaft 2 to thereby move the two cam element sections located close to each other in a direction in which the cam element sections are separated from each other.

That is, the first and second cam element sections $20_1$, $20_2$ located close to each other are separated from each other by the pin section 32 of the second operation device $30_2$. The third and fourth cam element sections $20_3$, $20_4$ located close to each other are separated from each other by the pin section 32 of the fifth operation device $30_5$. As a result, all of the first to fourth cam element sections $20_1$ to $20_4$ move from the first position shown in FIG. 1 to the second position shown in FIG. 4.

On the other hand, the pin sections 32 . . . 32 of the operation devices other than the second and fifth operation devices $30_2$, $30_5$, that is, the first, third, fourth, and sixth operation devices $30_1$, $30_3$, $30_4$, and $30_6$ are equivalent to "individual operation members" in claims. That is, the pin section 32 of the first operation device $30_1$ is a pin section exclusive for the end face cam 23 (the end face cam 23 on the front side of the cam element section $20_1$) located at the end portion on one side of the cylinder row. The pin section 32 of the sixth operation device $30_6$ is a pin section exclusive for the end face cam 23 (the end face cam 23 on the rear side of the cam element section $20_4$) located at the end portion on the other side of the cylinder row. The pin section 32 of the third operation device $30_3$ is a pin section exclusive for one (the cam 23 on the front side) of the end face cams 23, 23 opposed to each other of the cam element sections $20_2$, $20_3$ of the second cylinder $1_2$ and the third cylinder $1_3$ disposed adjacent to each other and discontinuous in ignition order. The pin section 32 of the fourth operation device $30_4$ is a pin section exclusive for the other (the cam 23 on the rear side) of the end face cams 23, 23. The pin sections 32 . . . 32 of the first, third, fourth, and sixth operation devices $30_1$, $30_3$, $30_4$, and $30_6$ move (project) to the actuation position when the cam element sections $20_1$ to $20_4$ are present in the second position to thereby individually move the cam element sections $20_1$ to $20_4$ to the first position.

Specifically, in a state in which the first cam element section $20_1$ is present in the second position closer to the front, the pin section 32 of the first operation device $30_1$ moves to the actuation position opposed to the end face cam 23 on the front side of the first cam element section $20_1$ in the axial direction and engages with the end face cam 23 according to the rotation of the cam shaft 2 to thereby move the first cam element section $20_1$ to the first position closer to the rear as shown in FIG. 1. Similarly, in a state in which the second cam element section $20_2$ is present in the second position closer to the rear, the pin section 32 of the third operation device $30_3$ moves to the actuation position opposed to the end face cam 23 on the rear side of the second cam element section $20_2$ in the axial direction and engages with the end face cam 23 according to the rotation of the cam shaft 2 to thereby move the second cam element section $20_2$ to the first position closer to the front.

Similarly, the third cam element section $20_3$ and the fourth cam element section $20_4$ are moved to the first position respectively by the pin sections 32, 32 of the fourth and sixth operation devices $30_4$, $30_6$. Consequently, all of the cam element sections $20_1$ to $20_4$ present in the second position move to the first position.

The movement (the projection) of the pin sections 32 of the operation devices $30_1$ to $30_6$ to the actuation position is performed at timing described below. That is, the projection of the pin sections 32 (the individual operation members) in the first, third, fourth, and sixth operation devices $30_1$, $30_3$, $30_4$, and $30_6$ is performed at timing when the reference planes c of the end face cams 23 corresponding to the pin sections 32 overlap projecting positions of the pin sections 32 (overlap the pin sections 32 after the projection in axial direction view). On the other hand, the projection of the pin sections 32 (the common operation members) in the second and fifth operation devices $\mathbf{30}_2$, $\mathbf{30}_5$ is performed at timing when both the reference planes c, c of the two end face cams 23, 23 opposed to each other overlap projecting positions of the pin sections 32.

The movement of the cam element sections $\mathbf{20}_1$ to $\mathbf{20}_4$ involved in the movement (the projection) of the pin sections 32 to the actuation position has to be performed at timing when the cam follower C' of the rocker arm C is in contact with the portion of the base circle a of the first cam section $\mathbf{22}_1$ or the second cam section $\mathbf{22}_2$, that is, when the cylinder is in a stroke other than an exhaust stroke.

Therefore, in order to satisfy these conditions of the actuation timing, as shown in FIG. 7 and FIG. 8, with respect to the vertexes of the nose sections $b_1$, $b_2$ of the first and second cam sections $\mathbf{22}_1$, $\mathbf{22}_2$, a lift start position (a start position of the lift sections d) e of the end face cam 23 is set in a position a predetermined angle apart in the forward side in the rotating direction X and a lift end position (an end position of the lift sections d) f of the end face cam 23 is set in a position a predetermined angle apart in the backward side in the rotating direction X, whereby the nose section $b_1$, $b_2$ of the first and second cam sections $\mathbf{22}_1$, $\mathbf{22}_2$ and the lift sections d of the end face cam 23 are in a positional relation in which the nose sections $b_1$, $b_2$ and the lift sections d overlap. In this case, according to a positional relation between the cam follower C' of the rocker arm C shown in FIG. 2 and the pin sections 32 of the operation devices $\mathbf{30}_1$ to $\mathbf{30}_6$, the cam element sections $\mathbf{20}_1$ to $\mathbf{20}_4$ move immediately after the end of the exhaust stroke.

Further, as shown in FIG. 5 to FIG. 8, in the cam element section $\mathbf{20}_1$, a first return cam 50 and a second return cam 51 that push back the pin sections 32, 32 of the first and second operation devices $\mathbf{30}_1$, $\mathbf{30}_2$ from the actuation position to the retracting position to thereby regulate the movement of the pin sections 32, 32 from the retracting position to the actuation position are provided. The first return cam 50 is provided to be located to correspond to a front portion of the cam element section $\mathbf{20}_1$, that is, the first operation device $\mathbf{30}_1$. The second return cam 51 is provided to be located to correspond to a rear portion of the cam element section $\mathbf{20}_1$, that is, the second operation device $\mathbf{30}_2$.

Figure 5:
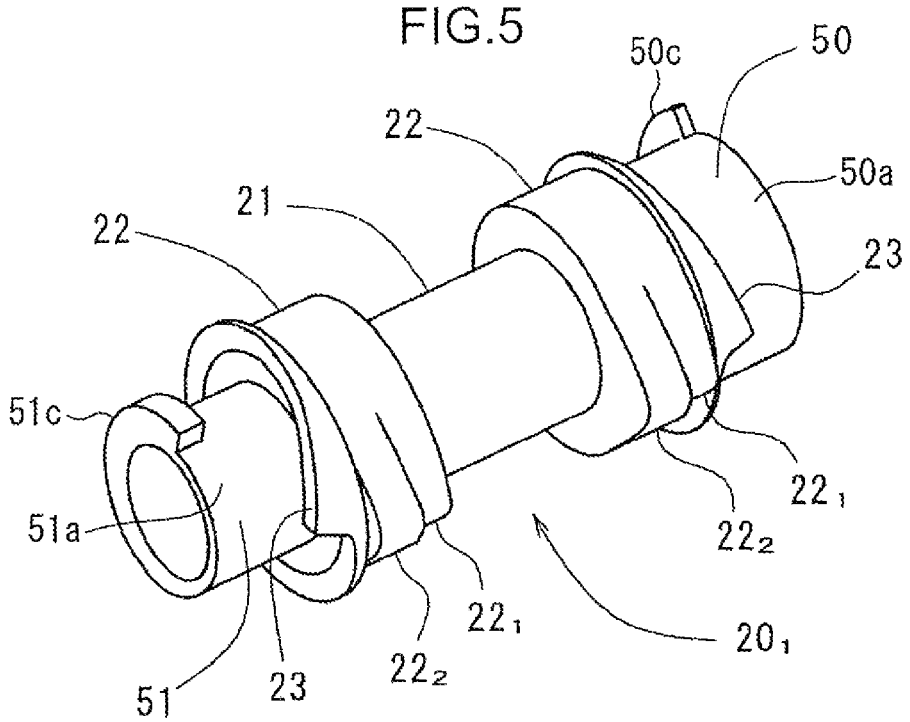
FIG. 5 is a perspective view of a cam element section alone.
Figure 6:
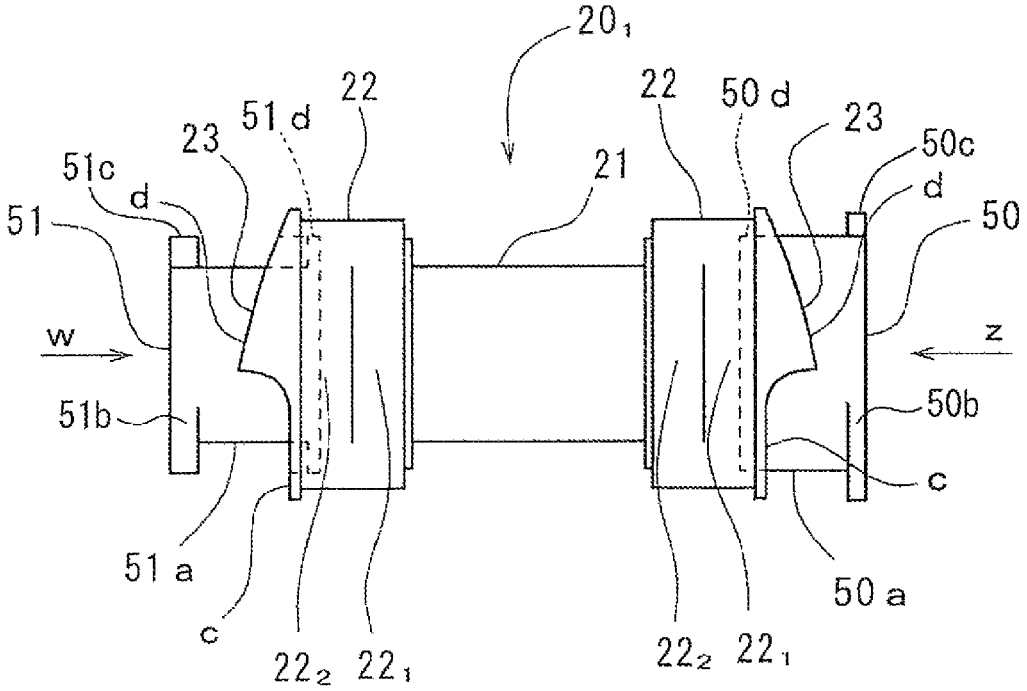
FIG. 6 is a side view of the cam element section alone.

The first return cam 50 includes, as shown in FIG. 5 to FIG. 7, a first reference plane 50*a* formed in a substantially cylindrical shape, a first slope section 50*b* and a first regulating section 50*c* formed to project in the radial direction at one end portion of the first reference plane 50*a*, and a first attaching section 50*d* (FIG. 6) formed at the other end portion of the first reference plane 50*a*. The first return cam 50 is attached to the front portion of the first cam element section $\mathbf{20}_1$ via a first attaching section 50*d*.

Similarly, the second return cam 51 includes, as shown in FIG. 5, FIG. 6, and FIG. 8, a second reference plane 51*a* formed in a substantially cylindrical shape, a second slope section 51*b* and a second regulating section 51*c* formed to project in the radial direction at one end portion of the second reference plane 51*a*, and a second attaching section 51*d* (FIG. 6) formed at the other end portion of the second reference plane 51*a*. The second return cam 51 is attached to a rear portion of the first cam element section $\mathbf{20}_1$ via the second attaching section 51*d*.

In a state in which the first return cam 50 is attached to the first cam element section $\mathbf{20}_1$, the first slope section 50*b* is formed such that a lift amount with respect to the reference plane 50*a* gradually increases from zero starting from the vicinity of an end position f of the end face cam 23 and is connected to the first regulating section 50*c* in an end position 50*e* of the first slope section 50*b*. The first regulating section 50*c* is formed to be contiguous to the backward side in the rotating direction X with respect to the first slope section 50*b* and have a fixed radius and is formed to return to the reference plane 50*a* in the vicinity of the start position e of the end face cam 23.

The radius of the first reference plane 50*a* is set to a value for preventing the pin section 32 of the first operation device $\mathbf{30}_1$ present in the actuation position indicated by a chain line in FIG. 7 and the first reference plane 50*a* from coming into contact with each other. The radius of the first regulating section 50*c* is set to a radius substantially the same as the outer circumferential surface of the end face cam 23 and is set to a value for preventing the pin section 32 of the first operation device $\mathbf{30}_1$ present in the retracting position and the first regulating section 50*c* from coming into contact with each other.

Axial direction positions of the first slope section 50*b* and the first regulating section 50*c* are set such that the first slope section 50*b* and the first regulating section 50*c* are located to be opposed to the pin section 32 of the first operation device $\mathbf{30}_1$ when the first cam element section $\mathbf{20}_1$ is present in the first position and such that the first slope section 50*b* and the first regulating section 50*c* are not located to be opposed to the pin section 32 of the first operation device $\mathbf{30}_1$ when the first cam element section $\mathbf{20}_1$ is present in the second position.

The same applies to the shape of the second return cam 51. That is, in a state in which the second return cam 51 is attached to the first cam element section $\mathbf{20}_1$, the second slope section 51*b* is formed such that a lift amount with respect to the reference plane 51*a* gradually increases from zero starting from the vicinity of the end position f of the end face cam 23 and is connected to the second regulating section 51*c* in an end position 51*e* of the second slope section. The second regulating section 51*c* is formed to be contiguous to the forward side in the rotating direction X with respect to the second slope section 51*b* and have a fixed radius and is formed to return to the reference plane 51*a* in the vicinity of the start position e of the end face cam 23.

The radius of the second reference plane 51*a* is set to a value for preventing the pin section 32 of the second operation device $\mathbf{30}_2$ present in the actuation position indicated by a chain line in FIG. 8 and the second reference plane 51*a* from coming into contact with each other. The radius of the second regulating section 51*c* is set to a radius slightly smaller than the outer circumferential surface of the end face cam 23 and is set to a value for preventing a small-diameter section 32*a* of the pin section 32 of the second operation device $\mathbf{30}_2$ present in the retracting position and the second regulating section 51*c* from coming into contact with each other. Note that the large-diameter portion 32*b* of the pin section 32 does not come into contact with the outer circumferential surface of the end face cam 23 when the pin section 32 is in the retracting position.

Axial direction positions of the second slope section 51*b* and the second regulating section 51*c* are set such that the second slope section 51*b* and the second regulating section 51*c* are located to be opposed to the pin section 32 of the second operation device $\mathbf{30}_2$ when the first cam element section $\mathbf{20}_1$ is present in the second position and such that the second slope section 51*b* and the second regulating section 51*c* are not located to be opposed to the pin section 32 of the second operation device $30_2$ when the first cam element section $20_1$ is present in the first position.

The first return cam 50 is disposed to correspond to the first, third, fourth, and sixth operation devices $30_1$, $30_3$, $30_4$, and $30_6$ including the cylindrical pin sections 32 . . . 32 and is configured such that the first slope section 50*b* and the first regulating section 50*c* act on the pin sections 32 . . . 32 of the operation devices after cam element sections $20_1$ to $20_4$ end movement from the second position to the first position with the operation devices $30_1$, $30_3$, $30_4$, and $30_6$.

That is, as shown in FIG. 1, the first return cam 50 is attached to the front portion of the first cam element section $20_1$, a rear portion of the second cam element section $20_2$, a front portion of the third cam element section $20_3$, and a rear portion of the fourth cam element section $20_4$. Consequently, in a state in which the cam element sections $20_1$ to $20_4$ are present in the first position, movement of the pin sections 32 . . . 32 of the first, third, fourth, and sixth operation devices $30_1$, $30_3$, $30_4$, and $30_6$ to the actuation position is regulated over a predetermined angle range by the first return cam 50.

The second return cam 51 is disposed to correspond to the second and fifth operation devices $30_2$, $30_5$ including the stepped-shape pin sections 32, 32 and is configured such that the second slope section 51*b* and the second regulating section 51*c* act on the pin sections 32, 32 of the operation devices $30_2$, $30_5$ after the cam element sections $20_1$ to $20_4$ end movement from the first position to the second position with the operation devices $30_2$, $30_5$.

The second return cam 51 is attached to only the cam element section that moves later in moving order of the two cam element sections to be moved by the second and fifth operation devices $30_2$, $30_5$ in the separating direction (from the first position to the second position).

That is, in the case of this embodiment, according to the ignition order, the cam element sections $20_1$ to $20_4$ are moved in the order of the second cylinder $1_2$→the first cylinder $1_1$→the third cylinder $1_3$→the fourth cylinder $1_4$ to switch a cam section that opens and closes the exhaust valves A of the cylinders $1_1$ to $1_4$. Therefore, the first cam element section $20_1$ is later in moving order of the first cam element section $20_1$ and the second cam element section $20_2$ moved in the separating direction by the pin section 32 (the common operation member) of the second operation device $30_2$. The fourth cam element $20_4$ is later in moving order of the third cam element section $20_3$ and the fourth cam element section $20_4$ moved in the separating direction by the pin section 32 (the common operation member) of the fifth operation device $30_5$. Therefore, the second return cam 51 (the second slope section 51*b* and the second regulating section 51*c*) that pushes back the pin sections 32 of the second and fifth operation devices $30_2$, $30_5$ is attached to the rear portion of the first cam element section $20_1$ and a front section of the forth cam element section $20_4$ as shown in FIG. 4. Consequently, in a state in which the cam element sections $20_1$ to $20_4$ are present in the second position, movement of the pin sections 32 of the second and fifth operation devices $30_2$, $30_5$ to the actuation position is regulated over a predetermined angle range by the second return cam 51.

Next, the operation of the valve system in the first embodiment is explained.

First, as shown in FIG. 1, for example, when the first to fourth cam element sections $20_1$ to $20_4$ are present in the first position during low-speed rotation of the engine, in all the cam element sections $20_1$ to $20_4$, the first cam sections $22_1$, $22_1$ having a small lift amount in the actuating sections 22, 22 at both the ends are located to correspond to the cam followers C', C' of the rocker arms C, C. According to the rotation of the cam shaft 2, in the ignition order explained above, the exhaust valves A . . . A of the cylinders $1_1$ to $1_4$ open at a relatively small valve opening amount during the exhaust stroke.

From this state, for example, when the cam section is switched to increase the valve opening amount of the exhaust valves A . . . A according to an increase in engine speed, the second and fifth operation devices $30_2$, $30_5$ are energized to move the respective pin sections 32, 32 from the retracting position to the actuation position.

Figure 9:
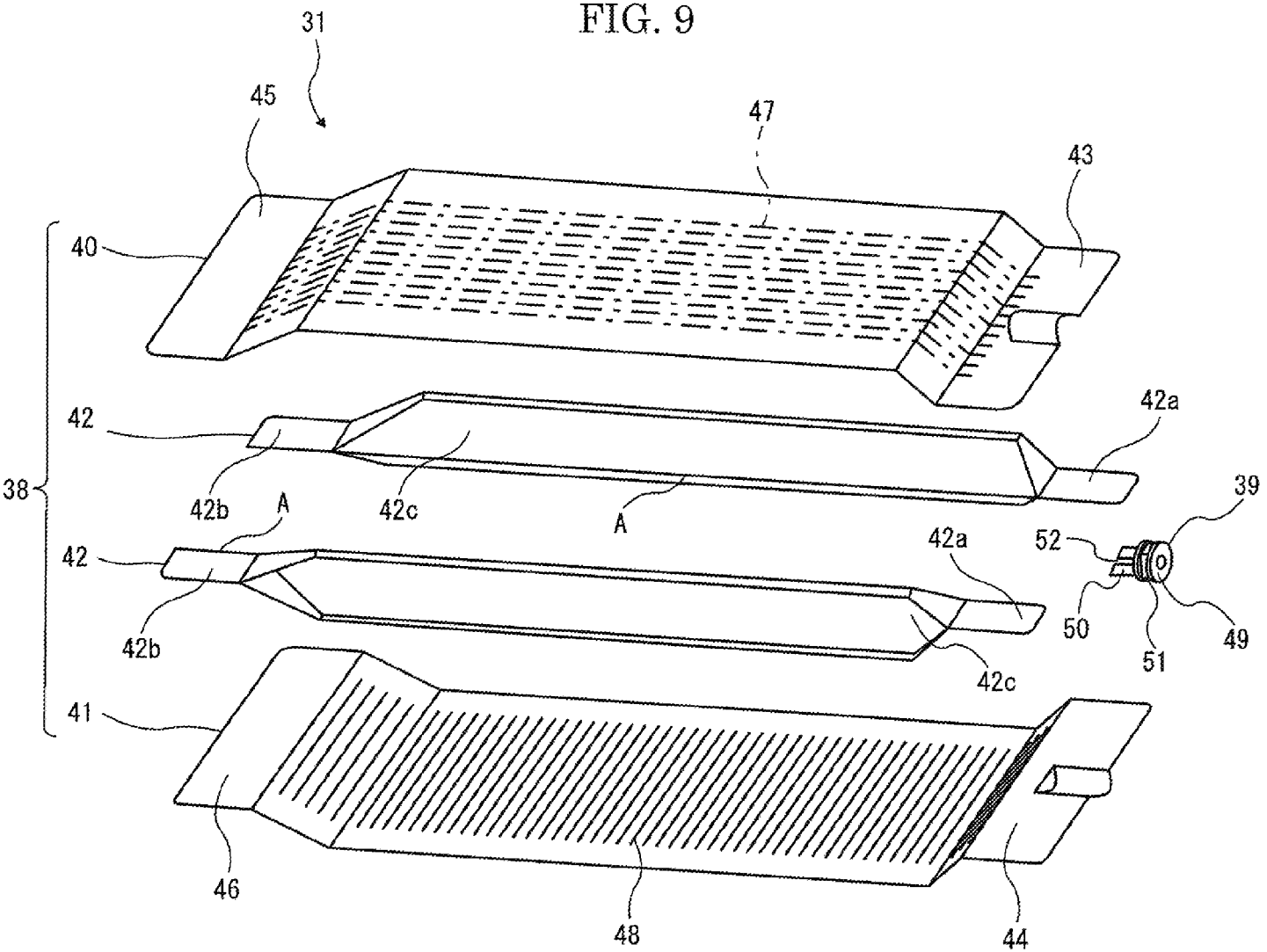
FIG. 9 is a main part development view developed along the circumference of an end face cam in order to show an angle range in which a second operation member (a pin section of a second operation device) can project.

That is, first, the pin section 32 of the second operation device $30_2$ rushes into between the opposed end face cams 23, 23 of the first and second cam element members $20_1$, $20_2$ present in the first position and in a state in which the end face cams 23, 23 are close to each other. The pin section 32 engages with the end face cams 23, 23. At this point, as shown in FIG. 9, the pin section 32 is rushes into an angle range R1 in which the reference planes c, c, a lift amount of which is zero, in the end face cams 23, 23 of the first and second cam element sections $20_1$, $20_2$ are opposed to each other. In other words, the pin section 32 is rushed into between the end face cams 23, 23 at timing when the portion of the angle range R1 in which the reference planes c, c are opposed to each other is located below the pin section 32.

Figure 10:
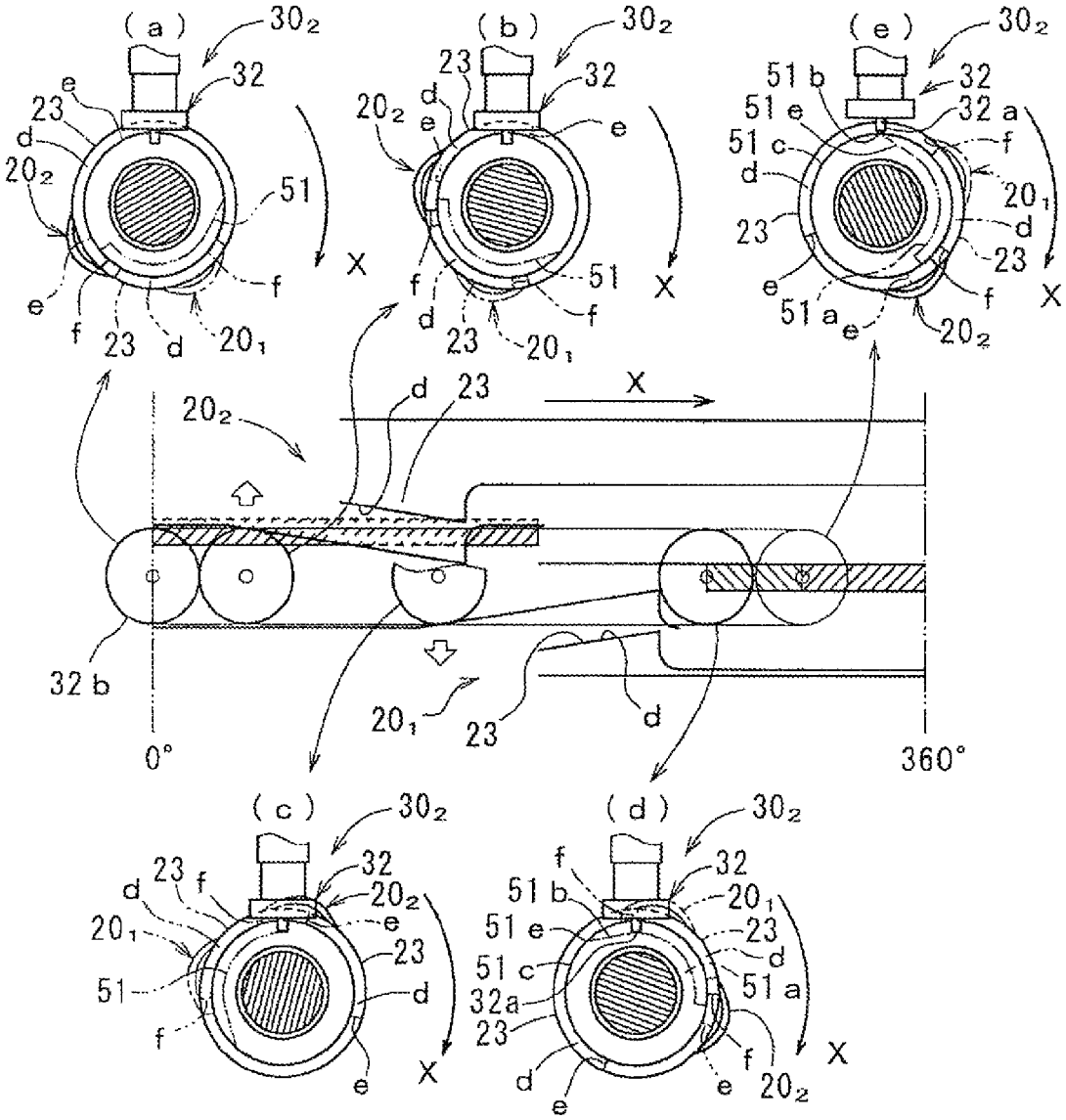
FIG. 10 is an operation explanatory diagram for showing operation in moving the cam element section with the second operation member.

After the exhaust stroke of the second cylinder $1_2$ shown in (a) of FIG. 10 ends, the lift start position e of the end face cam 23 on the front side of the second cam element section $20_2$ indicated by a solid line reaches the position of the pin section 32 of the second operation device $30_2$. Thereafter, as shown in (b) of FIG. 10, according to the rotation of the cam shaft 2, the pin section 32 pushes the second cam element section $20_2$ rearward while being in slide contact with the lift sections d of the end face cam 23 and moves the second cam element section $20_2$ to the second position.

After the lift start position e of the end face cam 23 of the second cam element section $20_2$ reaches the position of the pin section 32, when the cam shaft 2 rotates 90° and the exhaust stroke of the first cylinder $1_1$ ends, subsequently, the lift start position e of the end face cam 23 on the rear side of the first cam element section $20_1$ indicated by a chain line reaches the position of the pin section 32. Thereafter, as shown in (c) in FIG. 10, according to the rotation of the cam shaft 2, the pin section 32 pushes the first cam element section $20_1$ forward while being in slide contact with the lift sections d of the end face cam 23 and moves the first cam element section $20_1$ to the second position.

When the movement of the first cam element section $20_1$ to the second position is completed, as shown in (d) of FIG. 10, the slope section 51*b* of the second return cam 51 attached to the rear portion of the first cam element section $20_1$ is located to be opposed to the small-diameter section 32*a* of the pin section 32 of the second operation device $30_2$. Thereafter, when the energization to the second operation device $30_2$ is released, as shown in (e) of FIG. 10, according to the rotation of the cam shaft 2, the small-diameter section 32*a* of the pin section 32 is forcibly pushed back to the retracting position while being in slide contact with the slopes section 51*b*.

Figure 11:
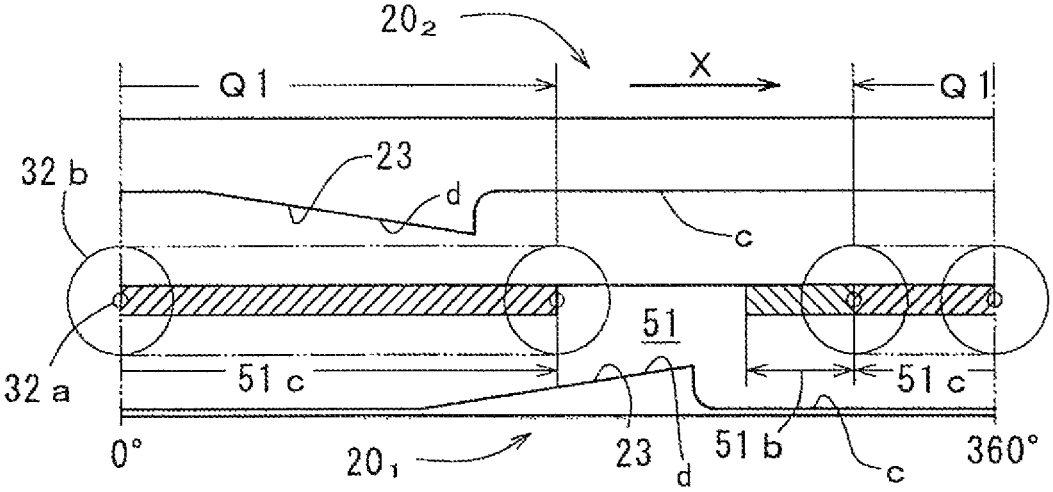
FIG. 11 is an element development view for showing an angle range in which movement of the second operation member to an actuation position is regulated.

In the state in which the first cam element section $20_1$ is present in the second position, in an angle range Q1 shown in FIG. 11, the second regulating section 51*c* of the second return cam 51 attached to the first cam element section $20_1$ is disposed in a position opposed to the small-diameter section 32*a* of the pin section 32 of the second operation device $30_2$. Consequently, the movement of the pin section 32 of the second operation device $30_2$ to the actuation position is regulated over the predetermined angle range Q1.

Subsequently, the pin section 32 of the fifth operation device $30_5$ rushes into between the opposed end face cams 23, 23 of the third and fourth cam element sections $20_3$, $20_4$ present in the first position and in a state in which the end face cams 23, 23 are close to each other. The pin section 32 engages with the end face cams 23, 23. Consequently, as in the case of the first and second cam element sections $20_1$, $20_2$, first, the pin section 32 moves the third cam element section $20_3$ to the second position and subsequently moves the fourth cam element section $20_4$ to the second position. Therefore, the pin section 32 is forcibly pushed back to the retracting position by the second return cam 51 attached to the fourth cam element section $20_4$.

In a state in which the forth cam element section $20_4$ is present in the second position, the movement of the pin section 32 of the fifth operation device $30_5$ to the actuation position is regulated over a predetermined angle range by the second regulating section 51*c* of the second return cam 51 attached to a front portion of the fourth cam element section $20_4$.

Consequently, all of the first to fourth cam element sections $20_1$ to $20_4$ move from the first position to the second position. As shown in FIG. 4, in all of the first to fourth cam element sections $20_1$ to $20_4$, the second cam sections $22_2$, $22_2$ are located to correspond to the cam followers C', C' of the rocker arms C, C and the exhaust valves A . . . A of the cylinders $1_1$ to $1_4$ open at a relatively large valve opening amount during the exhaust stroke.

Moreover, in the state in which the cam element sections $20_1$ to $20_4$ are present in the second position, the movement to the actuation position of the pin sections 32, 32 of the second and fifth operation devices $30_2$, $30_5$ used for moving the cam element sections $20_1$ to $20_4$ from the first position to the second position is regulated in the predetermined angle range.

On the other hand, when a state in which the second cam sections $22_2$ . . . $22_2$ having a large lift amount of the cam element sections $20_1$ to $20_4$ shown in FIG. 4 are located to correspond to the cam followers C', C' of the rocker arms C . . . C is switched to, according to, for example, a decrease in engine speed, a state in which the first cam sections $22_1$ . . . $22_1$ having a small lift amount shown in FIG. 1 are located to correspond to the cam followers C', C', the first, third, fourth, and sixth operation devices $30_1$, $30_3$, $30_4$, and $30_6$ are energized to move the pin sections 32 . . . 32 of the operation devices $30_1$, $30_3$, $30_4$, and $30_6$ from the retracting position to the actuation position.

Figure 12:
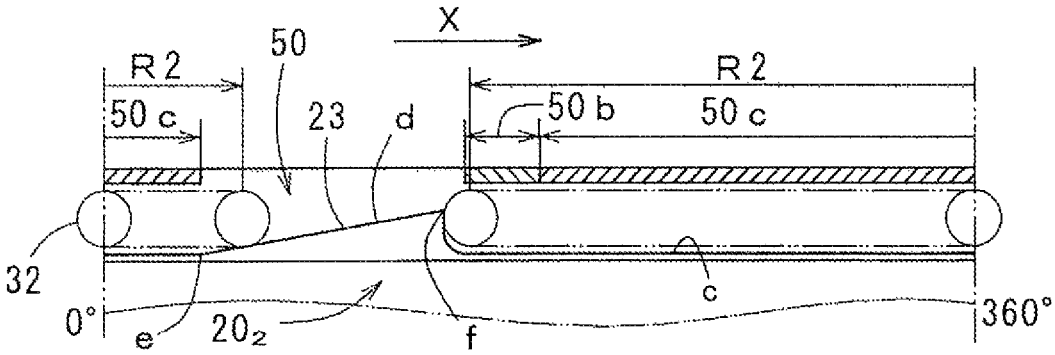
FIG. 12 is a main part development view developed along the circumference of the end face cam in order to show an angle range in which a third operation member (a pin section of a third operation device) can project.

That is, first, as shown in FIG. 12, the pin section 32 of the third operation device $30_3$ is rushed into an angle range R2 corresponding to the reference plane c of the end face cam 23 on the rear side of the second cam element section $20_2$ present in the second position. In other words, the pin section 32 is rushed into an opposing position of the end face cam 23 at timing when the portion of the angle range R2 corresponding to the reference plane c is located below the pin section 32.

Figure 13:
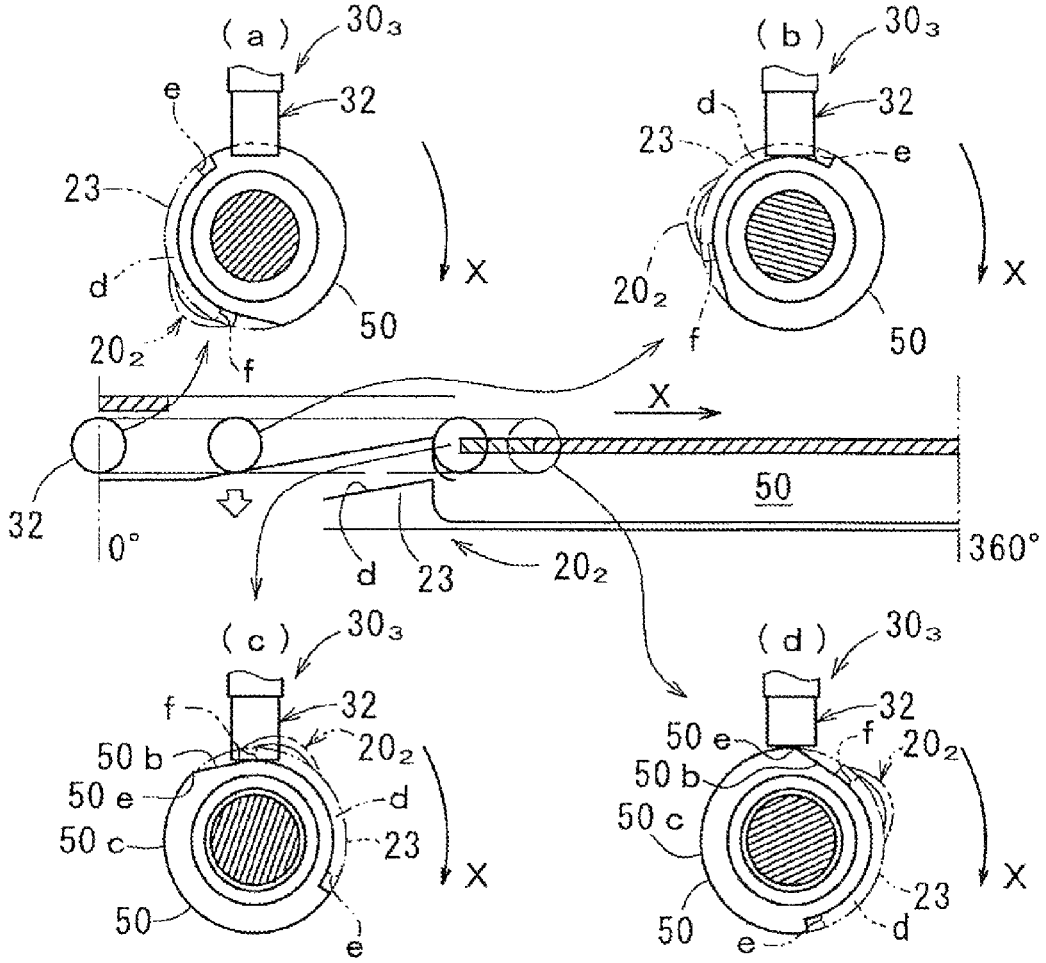
FIG. 13 is an operation explanatory diagram for showing operation in moving the cam element section with the third operation member.

After the exhaust stroke of the second cylinder $1_2$ shown in (a) of FIG. 13 ends, the lift start position e of the end face cam 23 on the rear side of the second cam element section $20_2$ reaches the position of the pin section 32 of the third operation device $30_3$. Thereafter, according to the rotation of the cam shaft 2, as shown in (b) of FIG. 13, the pin section 32 pushes the second cam element section $20_2$ forward while being in slide contact with the lift sections d of the end face cam 23 and moves the second cam element section $20_2$ to the first position.

When the movement of the second cam element section $20_2$ to the first position is completed, as shown in (c) of FIG. 13, the slope section 50*b* of the first return cam 50 attached to the rear portion of the second cam element section $20_2$ is located to be opposed to the pin section 32 of the third operation device $30_3$. Thereafter, when the energization to the third operation device $30_3$ is released, as shown in (d) of FIG. 13, according to the rotation of the cam shaft 2, the pin section 32 is forcibly pushed back to the retracting position while being in slide contact with the slope section 50*b*.

Figure 14:
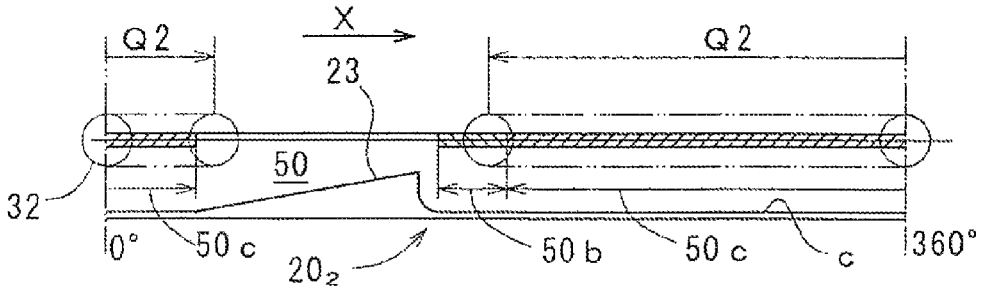
FIG. 14 is a main part development diagram for showing an angle range in which movement of the third operation member to the actuation position is regulated.

In a state in which the second cam element section $20_2$ is present in the first position, in an angle range Q2 shown in FIG. 14, the first regulating section 50*c* of the first return cam 50 attached to the second cam element section $20_2$ is disposed in a position opposed to the pin section 32 of the third operation device $30_3$. Consequently, the movement of the pin section 32 of the third operation device $30_3$ to the actuation position is regulated over the predetermined angle range Q2.

Subsequently, the first cam element section $20_1$ is pushed rearward by the first operation device $30_1$ and moves to the first position. Then, the pin section 32 of the first operation device $30_1$ is pushed back to the retracting position by the first return cam 50 attached to the front portion of the first cam element section $20_1$ present in the first position. The movement to the actuation position is regulated over the predetermined angle range.

Subsequently, the third cam element section $20_3$ is pushed rearward by the fourth operation device $30_4$ and moves to the first position. Then, the pin section 32 of the fourth operation device $30_4$ is pushed back to the retracting position by the first return cam 50 attached to the front portion of the third cam element section $20_3$ present in the first position. The movement to the actuation position is regulated over the predetermined angle range.

Subsequently, the fourth cam element section $20_4$ is pushed forward by the sixth operation device $30_6$ and moves to the first position. Then, the pin section 32 of the sixth operation device $30_6$ is pushed back to the retracting position by the first return cam 50 attached to the rear portion of the fourth cam element section $20_4$ present in the first position. The movement to the actuation position is regulated over the predetermined angle range.

Consequently, all of the first to fourth cam element sections $20_1$ to $20_4$ move from the second position to the first position. As shown in FIG. 1, in all of the first to fourth cam element sections $20_1$ to $20_4$, the first cam sections $22_1$, $22_1$ return to the state in which the first cam sections $22_1$, $22_1$ are located to correspond to the cam followers C', C' of the rocker arms C, C.

Moreover, in a state in which the cam element sections $20_1$ to $20_4$ move from the second position to the first position, the movement to the actuation position of the pin sections 32 . . . 32 of the first, third, fourth, and sixth operation devices $30_1$, $30_3$, $30_4$, and $30_6$ used for moving the cam element sections $20_1$ to $20_4$ from the second position to the first position is regulated over the predetermined angle range.

As explained above, according to the first embodiment, the second operation device $30_2$ is disposed in the position between the first and second cylinders $1_1$, $1_2$ disposed adjacent to each other and continuous in ignition order. The first and second cam element sections $20_1$, $20_2$ can be moved in the separating direction (from the first position to the second position) by projecting the second operation device $30_2$ when the first and second cam element sections $20_1$, $20_2$ are close to each other (present in the first position). Similarly, the fifth operation device $30_5$ is disposed in the position between the third and fourth cylinders $1_3$, $1_4$ disposed adjacent to each other and continuous in ignition order. The third and fourth cam element sections $20_3$, $20_4$ can be moved in the separating direction (from the first position to the second position) by projecting the fifth operation device $30_5$ when the third and fourth cam element sections $20_3$, $20_4$ are close to each other (present in the first position).

That is, cam element sections located close to each other can be separated and moved in the axial direction by disposing a single operation device in the position between two cylinders disposed adjacent to each other and continuous in ignition order. Therefore, it is possible to reduce the number of components of the operation device compared with when two operation devices are disposed in the position between cylinders.

The third and fourth operation devices $30_3$, $30_4$ are respectively disposed to correspond to the end face cams 23, 23 opposed to each other of the cam element sections $20_2$, $20_3$ of the second and third cylinders $1_2$, $1_3$ disposed to adjacent to each other and discontinuous in ignition order. The cam element sections $20_2$, $20_3$ can be respectively moved in the axial direction by respectively projecting the pin sections 32, 32 from the operation devices $30_3$, $30_4$ and engaging the pin sections 32, 32 with the end face cams 23, 23.

Figure 15A:
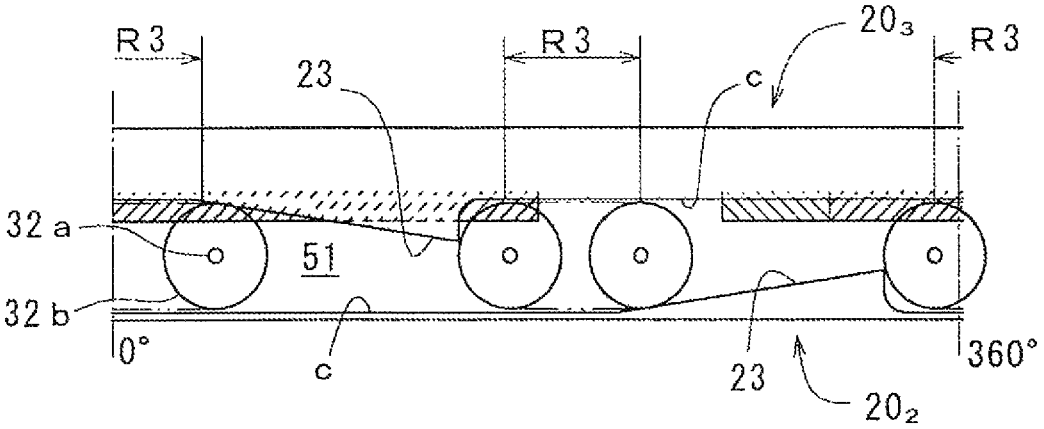
FIGS. 15A and 15B are main part development diagrams developed along the circumference of the end face cam in order to show an angle range in which the operation member can project when the cam element section is moved from a second position to a first position.
Figure 15B:
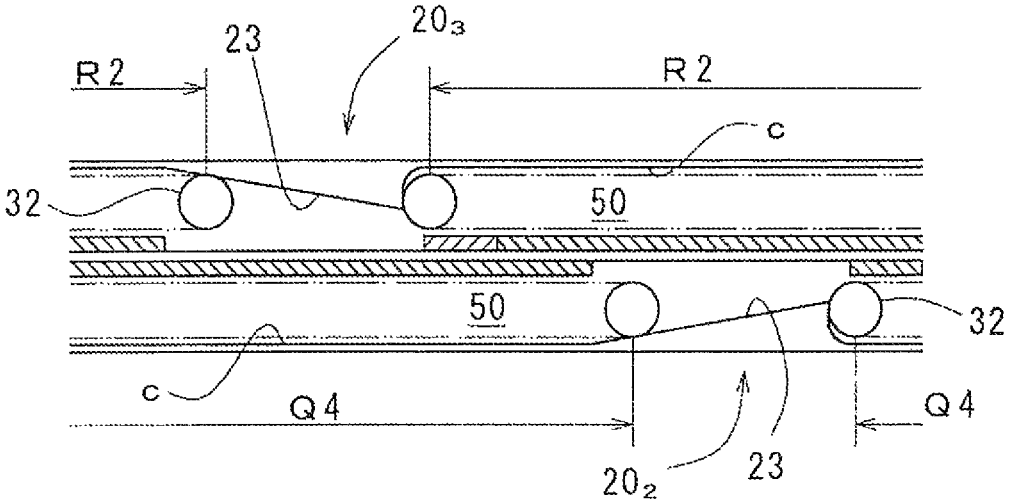

As shown in FIG. 15A, when a single operation device is disposed in the position between two cylinders disposed adjacent to each other and discontinuous in ignition order, timing when the pin section 32 can be projected is two divided narrow angle ranges R3, R3 in which the reference planes c, c of the both the opposed end face cams 23, 23 overlap. However, in this embodiment, as shown in FIG. 15B, dedicated operation devices (the third and fourth operation devices $30_3$, $30_4$) are respectively disposed in the end face cams 23, 23 opposed to each other between two cylinders (the second and third cylinders $1_2$, $1_3$) disposed to adjacent to each other and discontinuous in ignition order. Therefore, timing when the pin section 32 can be projected from the operation devices $30_3$, $30_4$ is not limited to the angle range in which the reference planes c, c of both the end face cams 23, 23 overlap and is the angle range R2 (see FIG. 12) of the reference planes c of the respective end face cams 23.

That is, by disposing two operation devices in the position between two cylinders disposed adjacent to each other and discontinuous in ignition order, the angle range in which the pin sections 32, 32 can be projected can be expanded compared with when the single operation device is disposed. Therefore, it is possible to properly move the pin sections 32, 32 and perform switching operation for the cam sections even during high-speed rotation of the engine without increasing projection speed of the pin section 32 by, for example, increasing the size of an actuator.

In the first embodiment, after the cam element sections $20_1$ to $20_4$ located to correspond to the pin section 32 moved to the actuation position are finished to be moved in the axial direction by the pin section 32, the pin section 32 can be pushed back to the retracting position by the first slope section 50*b* or the second slope section 51*b* provided in the cam element section. That is, while the cam shaft 2 rotates once, it is possible to surely move the pin sections 32 . . . 32 to the retracting position while surely performing the movement of the cam element sections $20_1$ to $20_4$.

Incidentally, when the cam element sections $20_1$ to $20_4$ are present in the first position, if the pin sections 32 . . . 32 of the first, third, fourth, and sixth operation devices $30_1$, $30_3$, $30_4$, and $30_6$ move to the actuation position, when the cam element sections $20_1$ to $20_4$ move to the second position, the pin sections 32 . . . 32 and the lift sections d . . . d of the end face cams 23 . . . 23 interfere with each other, leading to a switching failure of the cam sections. Similarly, when the cam element sections $20_1$ to $20_4$ are present in the second position, if the pin section 32, 32 of the second and fifth operation devices $30_2$, $30_5$ move to the actuation position, the pins 32, 32 interfere with the end face cams 23 . . . 23 of the cam element sections $20_1$ to $20_4$, which move to the first position, leading to a switching failure of the cam sections.

However, in the state in which the cam element sections $20_1$ to $20_4$ are present in the first position, the movement of the pin sections 32 . . . 32 of the first, third, fourth, and sixth operation devices $30_1$, $30_3$, $30_4$, and $30_6$ to the actuation position is regulated over the predetermined angle range by the first regulating section 50*c* formed to be contiguous to the first slope section 50*b*. Similarly, in the state in which the cam element sections $20_1$ to $20_4$ are present in the second position, the movement of the pin sections 32, 32 of the second and fifth operation devices $30_2$, $30_5$ to the actuation position is regulated over the predetermined angle range by the second regulating section 51*c* formed to be contiguous to the second slope section 51*b*.

That is, the movement of the pin sections 32 . . . 32 of the operation devices $30_1$ to $30_6$ to the actuation position due to a malfunction or the like is prevented. Consequently, interference of the pin sections 32 . . . 32 and the end face cams 23 . . . 23 of the cam element sections $20_1$ to $20_4$ is prevented. Therefore, it is possible to prevent occurrence of a switching failure of the cam sections and improve robustness of the valve system.

The second return cam 51 corresponding to the second operation device $30_2$ disposed between the two cylinders $1_1$, $1_2$ disposed adjacent to each other and continuous in ignition order is provided only in the first cam element section $20_1$ that moves later in moving order of the two cam element sections $20_1$, $20_2$ to be moved in the separating direction by the pin section 32 of the second operation device $30_2$. Similarly, the second return cam 51 corresponding to the fifth operation device $30_5$ disposed between the two cylinders $1_3$, $1_4$ disposed adjacent to each other and continuous in ignition order is provided only in the fourth cam element section $20_4$ that moves later in moving order of the two cam element sections $20_3$, $20_4$ to be moved in the separating direction by the pin section 32 of the fifth operation device $30_5$. Consequently, after the two sets of the cam element sections $20_1$, $20_2$ and $20_3$, $20_4$ disposed adjacent to each other are respectively properly moved in the separating direction, it is possible to push back the pin sections 32, 32 to the retracting position and prevent the movement of the pin sections 32, 32 to the actuation position over the predetermined angle range.

That is, with the valve system for the multi-cylinder engine according to the present invention, it is possible to easily perform the switching operation for the cams during high-speed rotation of the engine while reducing the number of components to attain compactness of the engine.

(Second Embodiment)

As in the first embodiment, the configuration on an exhaust side of a valve system of a four-cylinder four-valve DOHC engine is explained. The configurations of the first to fourth cam element sections $20_1$ to $20_4$ and the six operation devices $30_1$ to $30_6$ (the operation mechanism 30) of the electromagnetic type are different from the configurations in the first embodiment. The other configurations are the same.

Figure 16:
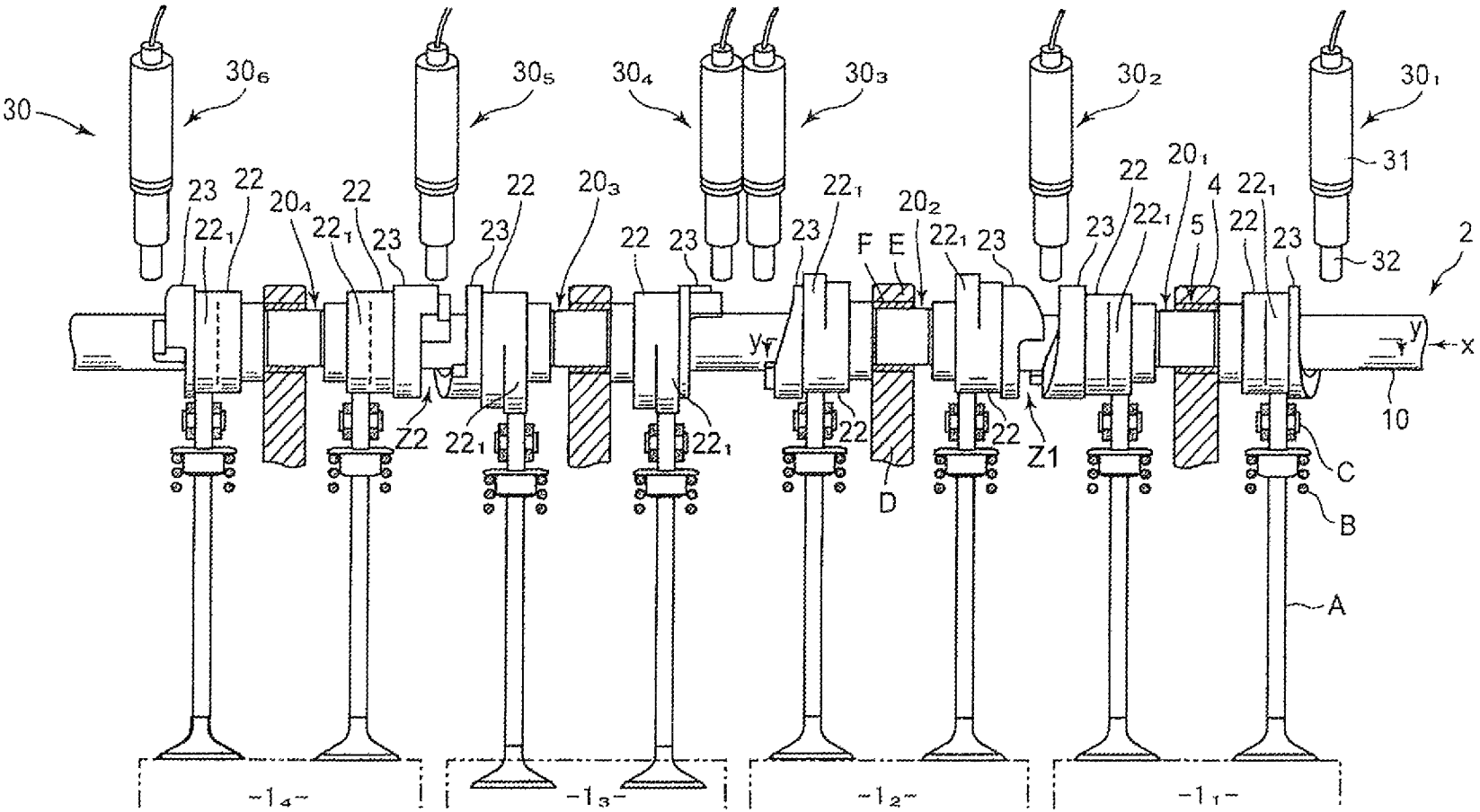
FIG. 16 is a side view showing the schematic configuration of an exhaust-side valve system according to a second embodiment of the present invention.

FIG. 16 shows the configuration on the exhaust side of the valve system according to the second embodiment. The valve system includes the cam shaft 2 and the operation mechanism 30. The cam shaft 2 includes the shaft section 10 and the first to fourth cam element sections $20_1$ to $20_4$ spline-fit in the shaft section 10 and capable of rotating integrally with the shaft section 10 and moving in an axial direction. The operation mechanism 30 includes the six operation devices $30_1$ to $30_6$ of the electromagnetic type that move the cam element sections $20_1$ to $20_4$ along the shaft section 10.

The operation devices $30_1$ to $30_6$ include the main bodies 31 incorporating the electromagnetic actuators, the substantially cylindrical pin sections 32 (operation members) capable of projecting from the main bodies 31 during energization to the electromagnetic actuators, and return springs (not shown in the figure) that press and urge the pin sections 32 to main bodies 31 side. In a state in which the electromagnetic actuators are not energized, as indicated by a dotted line in FIG. 17, the pin sections 32 are retained in the upward retracting position by urging force of the return springs. On the other hand, when the electromagnetic actuators are energized, as indicated by a solid line in FIG. 17, the pin sections 32 project downward resisting the return springs and move to the actuation position.

Figure 17:
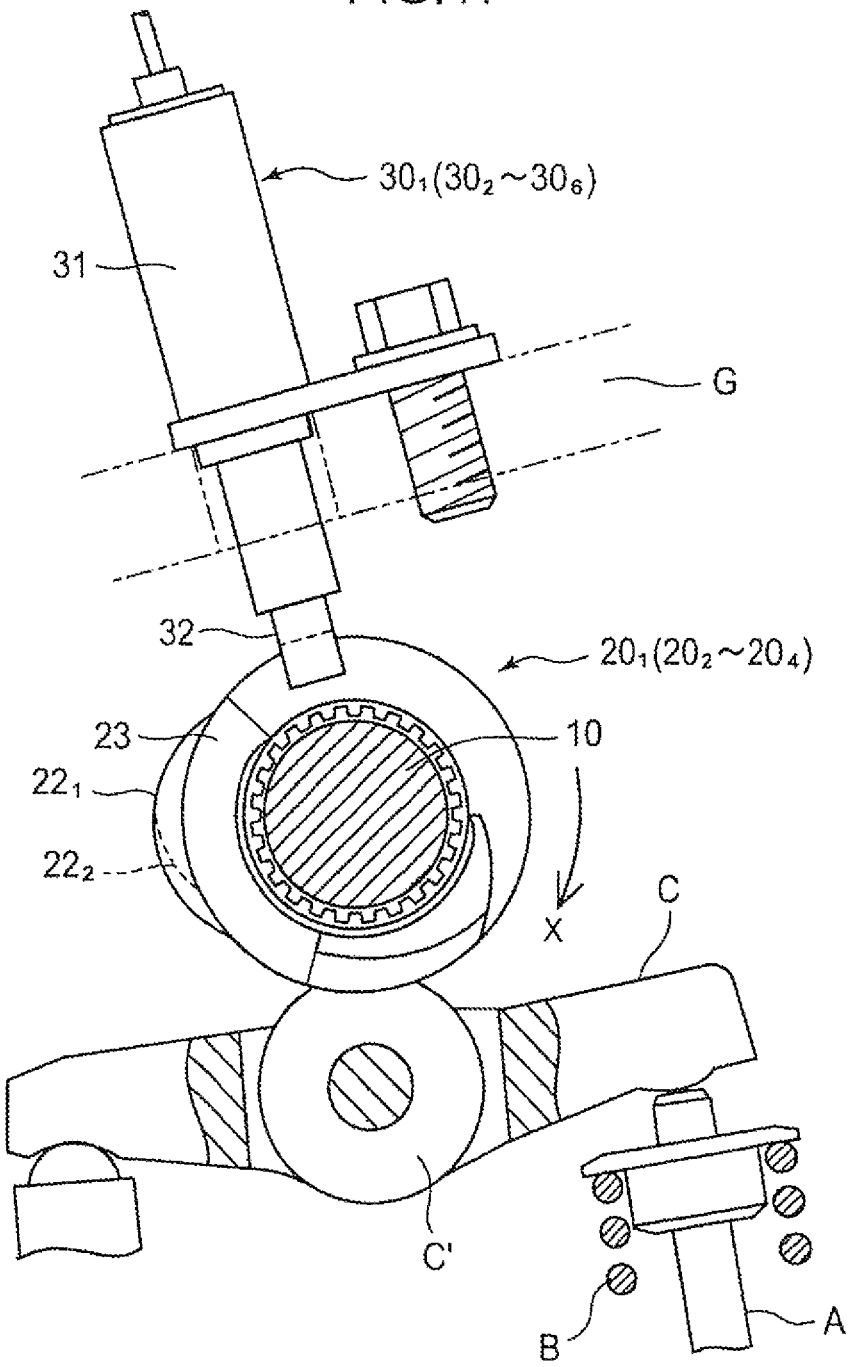
FIG. 17 is a front view of the valve system in an x-direction arrow view in FIG. 16.

As shown in FIG. 17, the operation devices $30_1$ to $30_6$ are disposed such that the pin section 32 is directed to the axis of the cam shaft 2 on the opposite side of the cam follower C' in the rocker arm C across the cam shaft 2. In the case of this embodiment, the operation devices $30_1$ to $30_6$ are attached to, in the same direction, a cylinder head cover G that covers the cam shaft 2 from above.

Energization to the operation devices $30_1$ to $30_6$ is performed according to an energization instruction to the operation devices $30_1$ to $30_6$ by a not-shown computer in a predetermined engine rotation angle period on the basis of a detection signal from a not-shown engine rotation angle sensor.

As shown in FIG. 16, when all of the first to fourth cam element sections $20_1$ to $20_4$ are present in the first position, the first cam element section $20_1$ is disposed in the rear, the second cam element section $20_2$ is disposed in the front, the third cam element section $20_3$ is disposed in the rear, and the fourth cam element section $20_4$ is disposed in the front. Therefore, the opposed end faces of the first and second cam element sections $20_1$, $20_2$ are close to each other. The opposed end faces of the second and third cam element sections $20_2$, $20_3$ are separated from each other. The opposed end faces of the third and fourth cam element sections $20_3$, $20_4$ are close to each other.

Figure 18:
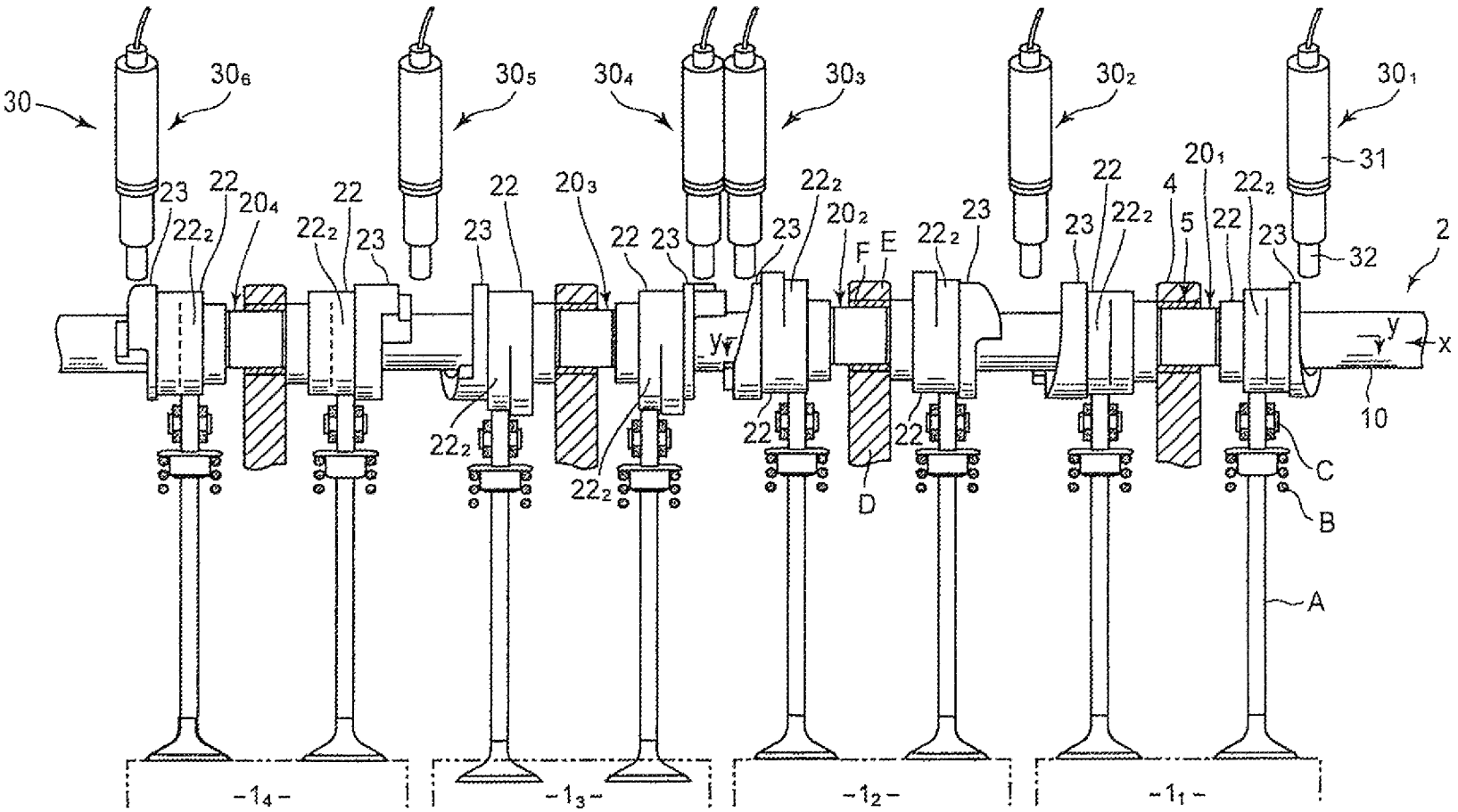
FIG. 18 is a side view showing a state in which a cam section that opens and closes a valve is switched from a state of FIG. 16.

As shown in FIG. 18, when all of the first to fourth cam element sections $20_1$ to $20_4$ are present in the second position, the first cam element section $20_1$ is located in the front, the second cam element section $20_2$ is located in the rear, the third cam element section $20_3$ is located in the front, and the fourth cam element section $20_4$ is located in the rear. Therefore, the opposed end faces of the first and second cam element sections $20_1$, $20_2$ are separated from each other. The opposed end faces of the second and third cam element sections $20_2$, $20_3$ are close to each other. The opposed end faces of the third and fourth cam element sections $20_3$, $20_4$ are separated from each other.

Next, the configuration of the cam element sections $20_1$ to $20_4$ is explained more in detail using the first cam element section $20_1$ and the second cam element section $20_2$ as an example with reference to FIG. 19 to FIG. 23B.

Figure 19:
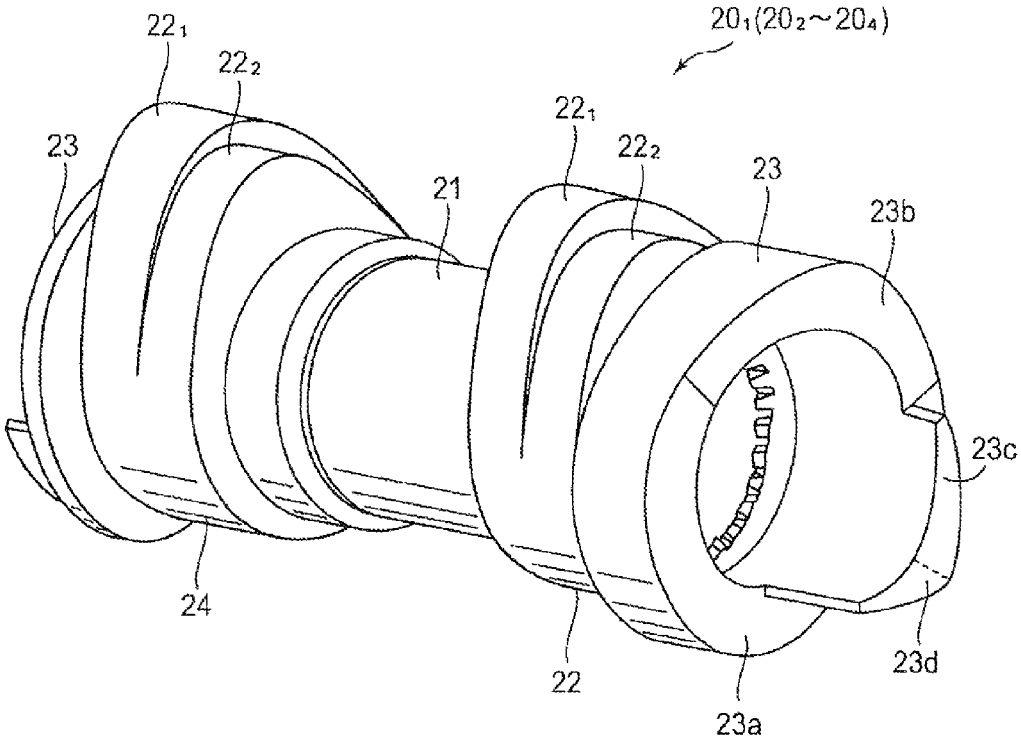
FIG. 19 is a perspective view of a cam element section alone

The cam element section $20_1$ ($20_2$ to $20_4$) is formed in a cylindrical shape. The outer circumferential surface in the intermediate section of the cam element section $20_1$ is formed as the journal section 21 supported by the bearing section F. The actuating sections 22, 22 for the two exhaust valves A, A of the cylinder are provided on both the front and rear sides of the journal section 21. In the actuation sections 22, 22, as shown in FIG. 19, the first cam section $22_1$ having a large lift amount for, for example, high-speed engine rotation time and the second cam section $22_2$ having a small lift amount for, for example, low-speed engine rotation time are provided adjacent to each other.

Figure 21A:
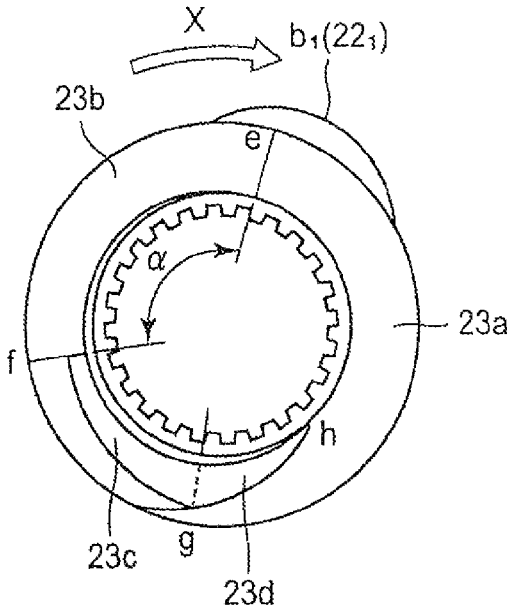
FIGS. 21A and 21B are front views of the cam element section shown in FIG. 20.
Figure 21B:
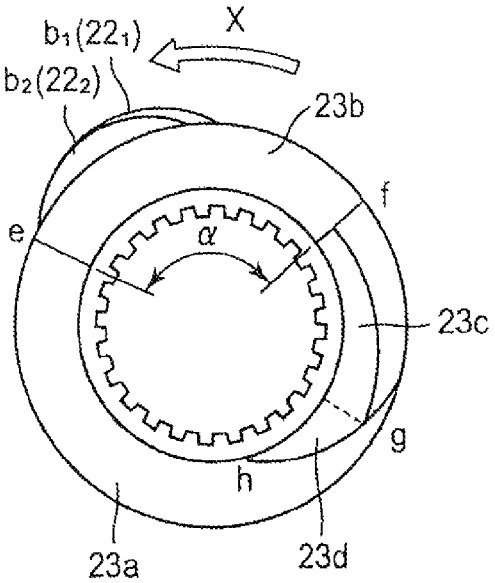

As shown in FIG. 21B, the first cam section $22_1$ and the second cam section $22_2$ respectively include the nose sections $b_1$, $b_2$ having different lift amounts. The nose sections $b_1$, $b_2$ are provided on the common base circle a with a slight phase difference. The first cam section $22_1$ and the second cam section $22_2$ are respectively provided with order of arrangement in the front-rear direction and phases of the nose sections $b_1$, $b_2$ matched in the actuating sections 22, 22 in the two places. Note that the common base circle a means that base circle diameters of the base circles a of the first cam section $22_1$ and the second cam section $22_2$ are the same.

As shown in FIG. 16 and FIG. 18, in the first cam element section $20_1$ and the third cam element section $20_3$, the first cam section $22_1$ is disposed in the front and the second cam section $22_2$ is disposed in the rear. In the second cam element section $20_2$ and the fourth cam element section $20_4$, the second cam section $22_2$ is disposed in the front and the first cam section $22_1$ is disposed in the rear.

The cam element sections $20_1$ to $20_4$ are set such that, when the cam element sections $20_1$ to $20_4$ are positioned in the first position on the shaft section 10 by a detent mechanism (not shown in the figure), as shown in FIG. 16, in all of the cam element sections $20_1$ to $20_4$, the two first cam sections $22_1$, $22_1$ are located to correspond to the cam followers C', C' (see FIG. 17) of the two rocker arms C, C of the corresponding one of the cylinders $1_1$ to $1_4$, and, when the cam element sections $20_1$ to $20_4$ are positioned in the second position on the shaft section 10, as shown in FIG. 18, the second cam sections $22_2$, $22_2$ are located to correspond to the cam followers C', C'.

In the engine according to this embodiment, ignition order of the cylinders is set as the third cylinder $1_3$→the fourth cylinder $1_4$→the second cylinder $1_2$→the first cylinder $1_1$. The first to fourth cam element sections $20_1$ to $20_4$ are spline-fit in the shaft section 10 with a phase difference of 90° from each other such that the nose sections $b_1$, $b_2$ of the first cam section $22_1$ or the second cam section $22_2$ of each of the cam element sections $20_1$ to $20_4$ press the cam followers C', C' of the cylinders in order according to the ignition order every time the cam shaft 2 rotates 90°.

Further, the end face cams 23, 23 are respectively provided at both front and rear end portions (both end portions in the axial direction) of each of the cam element sections $20_1$ to $20_4$.

Figure 20:
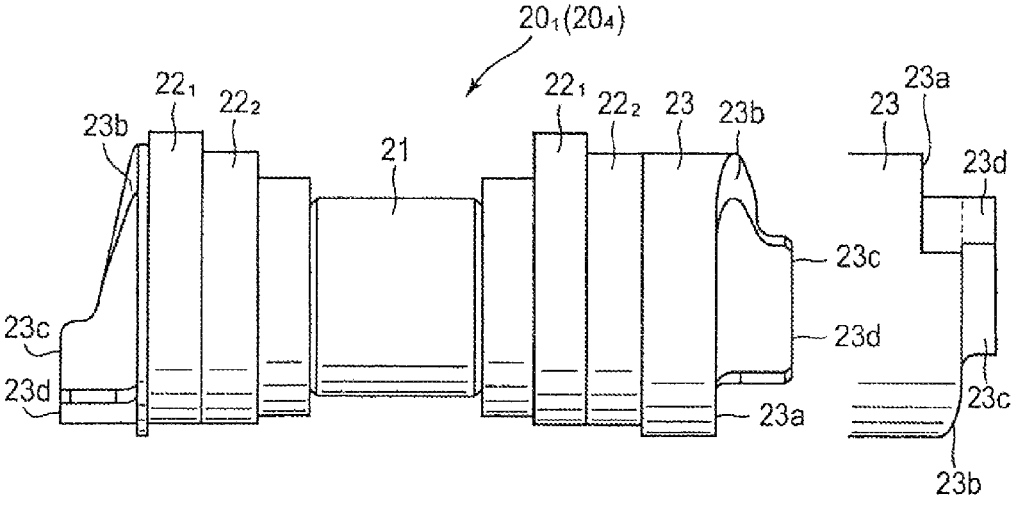
FIG. 20 is a side view of a cam element section of a first cylinder or a fourth cylinder.
Figure 22:
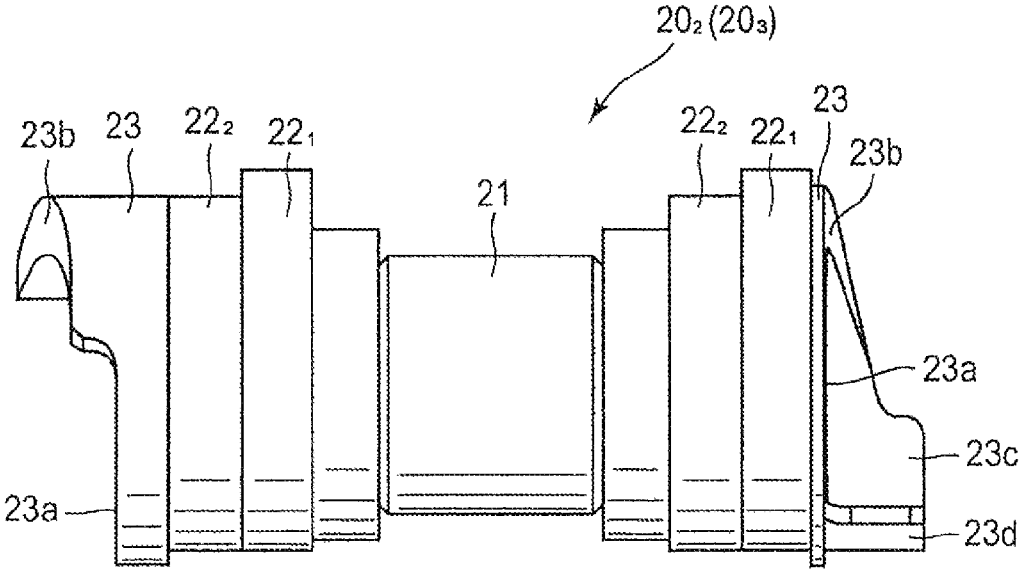
FIG. 22 is a side view of a cam element section of a second cylinder or a third cylinder.
Figure 23A:
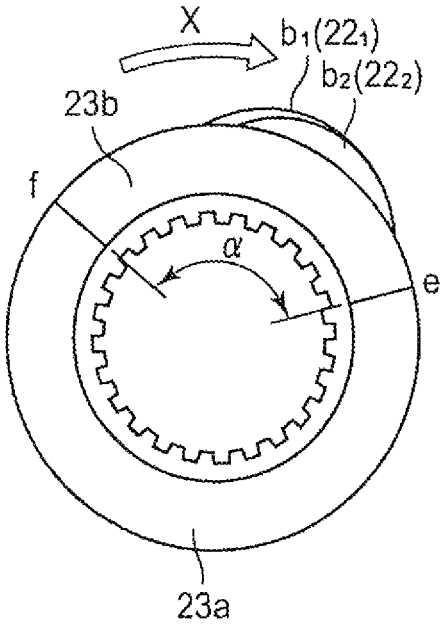
FIGS. 23A and 23B are front views of the cam element section shown in FIG. 22.
Figure 23B:
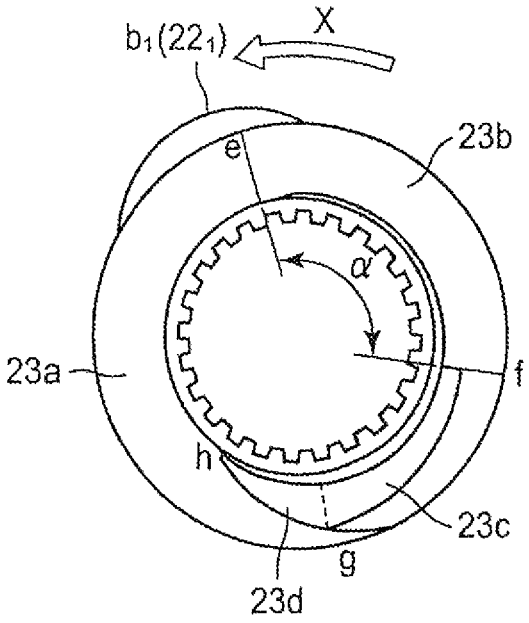

Each of the end face cams 23, 23 at both the front and rear end portions includes, as shown in FIG. 20 to FIG. 22, a reference plane 23*a* formed along a surface orthogonal to the axis of the cam element section $20_1$ ($20_2$ to $20_4$) and lift sections 23*b* respectively projecting to the front or the rear in the axial direction from the reference plane 23*a*. As shown in FIGS. 21A-B and FIGS. 23A-B, the lift sections 23*b* are formed such that a lift amount in the axial direction from the reference plane 23*a* (lift amount zero) gradually increases in the predetermined angle range α (e.g., about 120°) from the lift start position e to the lift end position f. Specifically, the lift amount of the lift sections 23*b* is set to be larger on the forward side in a rotating direction X of the cam shaft 2 and return to zero in the lift end position f or a slope end position g explained below.

Further, as explained above, the cam element sections $\mathbf{20}_1$ to $\mathbf{20}_4$ are spline-fit in the shaft section 10 with the predetermined phase difference from each other according to the ignition order of the cylinders $\mathbf{1}_1$ to $\mathbf{1}_4$. Accordingly, the end face cams 23, 23 opposed to each other of the cam element sections $\mathbf{20}_1$ to $\mathbf{20}_4$ are also opposed having a phase difference from each other. In this embodiment, as indicated by signs Z1, Z2 in FIG. 16, in the two first and second cam element sections $\mathbf{20}_1$, $\mathbf{20}_2$ and the two third and fourth cam element sections $\mathbf{20}_3$, $\mathbf{20}_4$ adjacent to each other, the lift sections 23*b*, 23*b* of the end face cams 23, 23 opposed to each other are provided in phases different from each other. At least a part of the lift sections 23*b*, 23*b* overlap in the axial direction when the two cam element sections $\mathbf{20}_1$ to $\mathbf{20}_4$ are close to each other.

The pin section 32 of the second operation device $\mathbf{30}_2$ is a common operation member disposed between the end face cams 23, 23 opposed to each other of the cam element sections $\mathbf{20}_1$, $\mathbf{20}_2$ of the first cylinder $\mathbf{1}_1$ and the second cylinder $\mathbf{1}_2$ disposed adjacent to each other and continuous in ignition order. Similarly, the pin section 32 of the fifth operation device $\mathbf{30}_5$ is a common operation member disposed between the end face cams 23, 23 opposed to each other of the cam element sections $\mathbf{20}_3$, $\mathbf{20}_4$ of the third cylinder $\mathbf{1}_3$ and the fourth cylinder $\mathbf{1}_4$ disposed adjacent to each other and continuous in ignition order.

Specifically, the pin section 32 of the second operation device $\mathbf{30}_2$ or the fifth operation device $\mathbf{30}_5$ moves to the actuation position when the two cam element sections ($\mathbf{20}_1$ and $\mathbf{20}_2$ or $\mathbf{20}_3$ and $\mathbf{20}_4$) corresponding to the pin section 32 are close to each other and projects between the end face cams 23, 23 opposed to each of both the cam element sections. The pin section 32 moved to the actuation position engages with the end face cams 23, 23 in order according to the rotation of the cam shaft 2 to thereby move the two cam element sections, which are close to each other, in a direction in which the two cam element sections are separated from each other.

Consequently, the first and second cam element sections $\mathbf{20}_1$, $\mathbf{20}_2$ move from the first position shown in FIG. 16 where the first and second cam element sections $\mathbf{20}_1$, $\mathbf{20}_2$ are close to each other to the second position shown in FIG. 18 where the first and second cam element sections $\mathbf{20}_1$, $\mathbf{20}_2$ are separated from each other. The third and fourth cam element sections $\mathbf{20}_3$, $\mathbf{20}_4$ also move from the first position shown in FIG. 16 where the third and fourth cam element sections $\mathbf{20}_3$, $\mathbf{20}_4$ are close to each other to the second position shown in FIG. 18 where the third and fourth cam element sections $\mathbf{20}_3$, $\mathbf{20}_4$ are separated from each other.

On the other hand, the pin sections 32 . . . 32 of the operation devices other than the second and fifth operation devices $\mathbf{30}_2$, $\mathbf{30}_5$, that is, the first, third, fourth, and sixth operation devices $\mathbf{30}_1$, $\mathbf{30}_3$, $\mathbf{30}_4$, and $\mathbf{30}_6$ are individual operation members respectively exclusively provided in the end face cams 23, 23 opposed each other of the cam element sections $\mathbf{20}_2$, $\mathbf{20}_3$ of the second cylinder $\mathbf{1}_2$ and the third cylinder $\mathbf{1}_3$ disposed adjacent to each other and discontinuous in ignition order, the end face cam 23 (the end face cam 23 on the front side of the cam element section $\mathbf{20}_1$) located at the front end portion of the cylinder row, and the end face cam 23 (the end face cam 23 on the rear side of the cam element section $\mathbf{20}_4$) located at the rear end portion of the cylinder row.

Specifically, in a state in which the first cam element section $\mathbf{20}_1$ is present in the second position closer to the front, the pin section 32 of the first operation device $\mathbf{30}_1$ moves to the actuation position opposed to the end face cam 23 on the front side of the first cam element section $\mathbf{20}_1$ in the axial direction and engages with the end face cam 23 according to the rotation of the cam shaft 2 to thereby move the first cam element section $\mathbf{20}_1$ to the first position closer to the rear as shown in FIG. 18. Similarly, in a state in which the third cam element section $\mathbf{20}_3$ is present in the second position closer to the front, the pin section 32 of the fourth operation device $\mathbf{30}_4$ moves to the actuation position opposed to the end face cam 23 on the front side of the third cam element section $\mathbf{20}_3$ in the axial direction and engages with the end face cam 23 according to the rotation of the cam shaft 2 to thereby move the third cam element section $\mathbf{20}_3$ to the first position closer to the rear.

In a state in which the second cam element section $\mathbf{20}_2$ is present in the second position closer to the rear, the pin section 32 of the third operation device $\mathbf{30}_3$ moves to the actuation position opposed to the end face cam 23 on the rear side of the second cam element section $\mathbf{20}_2$ in the axial direction and engages with the end face cam 23 to thereby move the second cam element section $\mathbf{20}_2$ to the first position closer to the front. Similarly, in a state in which the fourth cam element section $\mathbf{20}_4$ is present in the second position closer to the rear, the pin section 32 of the sixth operation device $\mathbf{30}_6$ moves to the actuation position opposed to the end face cam 23 on the rear side of the fourth cam element section $\mathbf{20}_4$ in the axial direction and engages with the end face cam 23 to thereby move the fourth cam element section $\mathbf{20}_4$ to the first position closer to the front.

The movement (the projection) of the pin sections 32 of the operation devices $\mathbf{30}_1$ to $\mathbf{30}_6$ is performed at timing explained below. That is, the projection of the pin sections 32 (the individual operation members) in the first and fourth operation devices $\mathbf{30}_1$, $\mathbf{30}_4$ is performed at timing when the reference planes 23*a* of the end face cams 23 on the front side of the first and third cam element sections $\mathbf{20}_1$, $\mathbf{20}_3$ overlap projecting positions of the pin sections 32 (overlap the pin sections 32 after the projection in axial direction view). Similarly, the projection of the pin sections 32 (the individual operation members) in the third and sixth operation devices $\mathbf{30}_3$, $\mathbf{30}_6$ is performed at timing when the reference planes 23*a* of the end face cams 23 on the rear side of the second and fourth cam element sections $\mathbf{20}_2$, $\mathbf{20}_4$ overlap the projecting positions of the pin section 32.

On the other hand, the projection of the pin section 32 (the common operation member) in the second operation device $\mathbf{30}_2$ is performed at timing when both the reference planes 23*a*, 23*a* of the two end face cams 23, 23 opposed to each other of the first and second cam element sections $\mathbf{20}_1$, $\mathbf{20}_2$ overlap a projecting position of the pin section 32. Similarly, the projection of the pin section 32 (the common operation member) in the fifth operation device $\mathbf{30}_5$ is performed at timing when both the reference planes 23*a*, 23*a* of the two end face cams 23, 23 opposed to each other of the third and fourth cam element sections $\mathbf{20}_3$, $\mathbf{20}_4$ overlap the projecting position of the pin section 32.

The movement of the cam element sections $\mathbf{20}_1$ to $\mathbf{20}_4$ involved in the movement (the projection) of the pin sections 32 to the actuation position has to be performed at timing when the cam follower C' of the rocker arm C is in contact with the base circle a of the first cam section $22_1$ or the second cam section $22_2$, that is, when the cylinder is in a stroke other than the exhaust stroke.

Therefore, in order to satisfy these conditions of actuation timing, in this embodiment, as shown in FIGS. 21A-B and FIGS. 23A-B, the lift start position (the start position of the lift sections 23*b*) e of the end face cam 23 is set in a position overlapping the nose sections $b_1$, $b_2$ of the first and second cam sections $22_1$, $22_2$ or a position in the vicinity on the forward side in the rotating direction X of the nose sections $b_1$, $b_2$. The lift end position (the end position of the lift sections 23*b*) f of the end face cam 23 is set in a position at the predetermined angle α on the backward side in the rotating direction X from the lift start position e. The lift sections 23*b* of the end face cam 23 are formed such that the angle α from the lift start position e of the end face cam 23 to the lift end position f of the end face cam 23 on the backward side in the rotating direction X is smaller than 180 degrees. In this case, according to a positional relation between the cam follower C' of the rocker arm C and the pin sections 32 of the operation devices $30_1$ to $30_6$ shown in FIG. 17, the cam element sections $20_1$ to $20_4$ move immediately after the end of the exhaust stroke.

However, even if the nose sections $b_1$, $b_2$ of the first and second cam sections $22_1$, $22_2$ and the lift sections 23*b* of the end face cam 23 are provided in the positional relation explained above, when the pin sections 32 of the operation devices $30_1$ to $30_6$ project at unintended timing because of an actuation failure or the like, it is likely that the pin sections 32 and the lift sections 23*b* engage carelessly. Therefore, in this embodiment, slope sections 23*c* for forcibly retracing (pushing back) the pin sections 32, which move to the actuation position, to the retracting position are integrally provided in the end face cams 23 of the cam element sections $20_1$ to $20_4$.

Places where the slop sections 23*c* should actually be provided change according to conditions such as order of switching of the cam sections 22 of the cam element sections $20_1$ to $20_4$ and the number of arranged operation devices 30. In this embodiment, the slope sections 23*c* are respectively provided at both the front and rear ends of the first cam element section $20_1$, the rear end of the second cam element section $20_2$, the front end of the third cam element section $20_3$, and both the front and rear ends of the fourth cam element section $20_4$. On the other hand, the slope sections 23*c* are not provided at the front end of the second cam element section $20_2$ and the rear end of the third cam element section $20_3$.

That is, in the case of this embodiment, according to the ignition order, the cam element sections $20_1$ to $20_4$ are moved in the order of the third cylinder $1_3$→the fourth cylinder $1_4$→the second cylinder $1_2$→the first cylinder $1_1$ to switch a cam section that opens and closes the exhaust valves A of the cylinders $1_1$ to $1_4$. Therefore, the first cam element section $20_1$ is later in moving order of the first cam element section $20_1$ and the second cam element section $20_2$ moved in the separating direction by the pin section 32 (the common operation member) of the second operation device $30_2$. The fourth cam element $20_4$ is later in moving order of the third cam element section $20_3$ and the fourth cam element section $20_4$ moved in the separating direction by the pin section 32 (the common operation member) of the fifth operation device $30_5$. Therefore, the slope section 23*c* that pushes back the pin sections 32 of the second operation device $30_2$ is provided only at the rear end of the first cam element section $20_1$ that is later in the moving order. The slope section 23*c* is not provided at the front end of the second cam element section $20_2$ that is earlier in the moving order. The slope section 23*c* that pushes back the pin section 32 of the fifth operation device $30_5$ is provided only at the front end of the fourth cam element section $20_4$ that is later in the moving order. The slope section 23*c* is not provided at the rear end of the third cam element section $20_3$ that is earlier in the moving order.

As shown in FIGS. 20 to 23B, the slope section 23*c* is formed to further project in the axial direction than the lift section 23*b* on the end face of the end face cam 23. The slope section 23*c* is provided over a predetermined angle range further on a rotation delay side (the opposite direction of the arrow X) than the lift end position f of the end face cam 23, more specifically, an angle range from the lift end position (a slope start position) f to the slope end position g. The external circumferential surface of the slope section 23*c* is formed as a cam surface, a lift amount (a radius) of which in the radial direction gradually increases toward the rotation delay side. The lift amount of the cam surface is set such that the cam surface in the slope start position f is slightly lower than the distal end portion of the pin section 32 present in the actuation position and the cam surface in the slope end position g is slightly lower than the distal end portion of the pin section 32 present in the retracting position.

The slope section 23*c* having the cam surface of such a shape can retract the pin section 32 from the actuation position to the retracting position by coming into slide contact with the distal end portion of the pin section 32 after the movement of the cam element sections $20_1$ to $20_4$ by the lift section 23*b* ends. Note that, as explained above, the cam surface in the slope end position g is lower than the distal end portion of the pin section 32 present in the retracting position. However, the pin section 32 is pushed back to the retracting position away from the cam surface by inertial force applied to the pin section 32 in the period from the slope start position f to the slope end position g and the magnetic force of the electromagnetic actuator.

Further, reverse-rotation-time return slope sections 23*d* for forcibly pushing back the pin sections 32, which move to the actuation position, to the retracting position when the cam shaft 2 reversely rotates are integrally provided on the end face cams 23 of the cam element sections $20_1$ to $20_4$.

The reverse-rotation-time return slope sections 23*d* are provided together with the slope sections 23*c* on the end face cams 23 on which the slope sections 23*c* are provided among the end face cams 23, 23 at both the ends of the cam element sections $20_1$ to $20_4$. In the case of this embodiment, the reverse-rotation-time return slope sections 23*d* are respectively provided at both the front and rear ends of the first cam element section $20_1$, the rear end of the second cam element section $20_2$, the front end of the third cam element section $20_3$, and both the front and rear ends of the fourth cam element section $20_4$.

The slope sections 23*c* and the reverse-rotation-time return slope sections 23*d* are provided such that, when the adjacent cam element sections are close to each other, the end face cams 23, 23 opposed to each other, in particular, the slope sections 23*c* and the reverse-rotation-time return slope sections 23*d* of the end face cams 23 and the lift sections 23*b* of the other end face cams 23 opposed to the end face cams 23 do not interfere with each other.

Next, the operation of the valve system in the second embodiment is explained.

First, as shown in FIG. 16, for example, when the first to fourth cam element sections $20_1$ to $20_4$ are present in the first position during high-speed rotation of the engine, in all of the cam element sections $20_1$ to $20_4$, the first cam sections $22_1$, $22_1$ having a large lift amount in the actuating sections 22, 22 at both the ends are located to correspond to the cam followers C', C' of the rocker arms C, C. According to the rotation of the cam shaft 2, in the ignition order explained above, the exhaust valves A . . . A of the cylinders $1_1$ to $1_4$ open at a relatively large valve opening amount during the exhaust stroke.

From this state, for example, when the cam section is switched to decrease the valve opening amount of the exhaust valves A . . . A according to a decrease in engine speed, the second and fifth operation devices $30_2$, $30_5$ are energized to move the respective pin sections 32, 32 from the retracting position to the actuation position.

That is, first, the pin section 32 of the fifth operation device $30_5$ rushes into between the opposed end face cams 23, 23 of the third and fourth cam element members $20_3$, $20_4$ present in the first position and in a state in which the end face cams 23, 23 are close to each other. The pin section 32 engages with the end face cams 23, 23. At this point, the pin section 32 is rushes into an angle range in which the reference planes 23*a*, 23*a*, a lift amount of which is zero, in the end face cams 23, 23 of the third and fourth cam element sections $20_3$, $20_4$ are opposed to each other. In other words, the pin section 32 is rushed into between the end face cams 23, 23 at timing when the portion of the angle range in which the reference planes 23*a*, 23*a* are opposed to each other is located below the pin section 32.

After the exhaust stroke of the third cylinder $1_3$ ends, the lift start position e of the end face cam 23 on the rear side of the third cam element section $20_3$ reaches the position of the pin section 32 of the fifth operation device $30_5$. Thereafter, according to the rotation of the cam shaft 2, the pin section 32 pushes the third cam element section $20_3$ forward while being in slide contact with the lift sections 23*b* of the end face cam 23 and moves the third cam element section $20_3$ to the second position.

After the lift start position e of the end face cam 23 of the third cam element section $20_3$ reaches the position of the pin section 32, when the cam shaft 2 rotates 90° and the exhaust stroke of the fourth cylinder $1_4$ ends, subsequently, the lift start position e of the end face cam 23 on the rear side of the fourth cam element section $20_4$ reaches the position of the pin section 32. Thereafter, according to the rotation of the cam shaft 2, the pin section 32 pushes the fourth cam element section $20_4$ rearward while being in slide contact with the lift sections 23*b* of the end face cam 23 and moves the fourth cam element section $20_4$ to the second position.

Thereafter, the energization to the electromagnetic actuator of the fifth operation device $30_5$ is stopped, the distal end face of the pin section 32 is pushed up while being in slide contact with the cam surface of the slope section 23*c*, and the pin section 32 is forcibly pushed back to the retracting position. Thereafter, the pin section 32 is retained in the retracting position by urging force of the return spring.

Subsequently, the pin section 32 of the second operation device $30_2$ rushes into between the opposed end face cams 23, 23 of the first and second cam element sections $20_1$, $20_2$ present in the first position and in a state in which the end face cams 23, 23 are close to each other. The pin section 32 engages with the end face cams 23, 23. At this point, the pin section 32 is rushes into an angle range in which the reference planes 23*a*, 23*a*, a lift amount of which is zero, in the end face cams 23, 23 of the first and second cam element sections $20_1$, $20_2$ are opposed to each other.

After the exhaust stroke of the second cylinder $1_2$ ends, the lift start position e of the end face cam 23 on the front side of the second cam element section $20_2$ reaches the position of the pin section 32 of the second operation device $30_2$. Thereafter, according to the rotation of the cam shaft 2, the pin section 32 pushes the second cam element section $20_2$ rearward while being in slide contact with the lift sections 23*b* of the end face cam 23 and moves the second cam element section $20_2$ to the second position.

After the lift start position e of the end face cam 23 of the second cam element section $20_2$ reaches the position of the pin section 32, when the cam shaft 2 rotates 90° and the exhaust stroke of the first cylinder $1_1$ ends, subsequently, the lift start position e of the end face cam 23 on the front side of the first cam element section $20_1$ reaches the position of the pin section 32. Thereafter, according to the rotation of the cam shaft 2, the pin section 32 pushes the first cam element section $20_1$ forward while being in slide contact with the lift sections 23*b* of the end face cam 23 and moves the first cam element section $20_1$ to the second position.

Further, the energization to the electromagnetic actuator of the second operation device $30_2$ is stopped, the distal end face of the pin section 32 is pushed up while being in slide contact with the cam surface of the slope section 23*c*, and the pin section 32 is forcibly pushed back to the retracting position. Thereafter, the pin section 32 is retained in the retracting position by urging force of the return spring.

Consequently, all of the first to fourth cam element sections $20_1$ to $20_4$ move from the first position to the second position. As shown in FIG. 18, in all of the first to fourth cam element sections $20_1$ to $20_4$, the second cam sections $22_2$, $22_2$ are located to correspond to the cam followers C', C' of the rocker arms C, C and the exhaust valves A . . . A of the cylinders $1_1$ to $1_4$ open at a relatively small valve opening amount during the exhaust stroke.

On the other hand, when a state in which the second cam sections $22_2$ . . . $22_2$ having a small lift amount of the cam element sections $20_1$ to $20_4$ shown in FIG. 18 are located to correspond to the cam followers C', C' of the rocker arms C . . . C is switched to, according to, for example, an increase in engine speed, a state in which the first cam sections $22_1$ . . . $22_1$ having a large lift amount shown in FIG. 16 are located to correspond to the cam followers C', C', the first, third, fourth, and sixth operation devices $30_1$, $30_3$, $30_4$, and $30_6$ are energized to move the pin sections 32 . . . 32 of the operation devices $30_1$, $30_3$, $30_4$, and $30_6$ from the retracting position to the actuation position.

That is, first, the pin section 32 of the fourth operation device $30_4$ is rushed into an angle range corresponding to the reference plane 23*a* of the end face cam 23 on the front side of the third cam element section $20_3$. In other words, the pin section 32 is rushed into an opposing position of the end face cam 23 at timing when the portion of the angle range corresponding to the reference plane 23*a* is located below the pin section 32.

After the exhaust stroke of the third cylinder $1_3$ ends, the lift start position e of the end face cam 23 on the rear side of the third cam element section $20_3$ reaches the position of the rushed-in pin section 32 of the fourth operation device $30_4$. Thereafter, according to the rotation of the cam shaft 2, the pin section 32 pushes the third cam element section $20_3$ rearward while being in slide contact with the lift sections 23*b* of the end face cam 23 and moves the third cam element section $20_3$ to the first position.

After the lift start position e of the end face cam 23 of the third cam element section $20_3$ reaches the position of the pin section 32 of the fourth operation device $30_4$, when the cam shaft 2 rotates 90° and the exhaust stroke of the third cylinder $1_3$ ends, subsequently, the pin section 32 of the sixth operation device $30_6$ is rushed into an angle range corresponding to the reference plane 23*a* of the end face cam 23 on the rear side of the fourth cam element section $\mathbf{20}_4$ present in the second position and engages with the end face cam 23.

After the exhaust stroke of the fourth cylinder $\mathbf{1}_4$ ends, the lift start position e of the end face cam 23 on the rear side of the fourth cam element section $\mathbf{20}_4$ reaches the position of the rushed-in pin section 32 of the sixth operation device $\mathbf{30}_6$. Thereafter, according to the rotation of the cam shaft 2, the pin section 32 pushes the fourth cam element section $\mathbf{20}_4$ forward while being in slide contact with the lift sections 23*b* of the end face cam 23 and moves the fourth cam element section $\mathbf{20}_4$ to the first position.

Thereafter, when the slope section 23*c* of the end face cam 23 of the fourth cam element section $\mathbf{20}_4$ is absent below the pin section 32 of the fifth operation device $\mathbf{30}_5$, the pin section 32 is capable of moving in the actuation position.

Subsequently, the pin section 32 of the third operation device $\mathbf{30}_3$ is rushed into an angle range corresponding to the reference plane 23*a* of the end face cam 23 on the rear side of the second cam element section $\mathbf{20}_2$ present in the second position. According to the rotation of the cam shaft 2, the pin section 32 pushes the second cam element section $\mathbf{20}_2$ forward while being in slide contact with the lift sections 23*b* of the end face cam 23 and moves the second cam element section $\mathbf{20}_2$ to the first position.

Substantially in parallel to the movement of the second cam element section $\mathbf{20}_2$, the pin section 32 of the first operation device $\mathbf{30}_1$ is rushed into an angle range corresponding to the reference plane 23*a* of the end face cam 23 on the front side of the first cam element section $\mathbf{20}_1$ present in the second position.

Further, after the lift start position e of the end face cam 23 of the second cam element section $\mathbf{20}_2$ reaches the position of the pin section 32 of the third operation device $\mathbf{30}_3$, when the cam shaft 2 rotates 90° and the exhaust stroke of the first cylinder $\mathbf{1}_1$ ends, the lift start position e of the end face cam 23 on the front side of the first cam element section $\mathbf{20}_1$ reaches the position of the pin section 32 of the first operation device $\mathbf{30}_1$. Then, according to the rotation of the cam shaft 2, the pin section 32 pushes the first cam element section $\mathbf{20}_1$ rearward while being in slide contact with the lift section 23*b* of the end face cam 23 and moves the first cam element section $\mathbf{20}_1$ to the first position.

Consequently, all of the first to fourth cam element sections $\mathbf{20}_1$ to $\mathbf{20}_4$ move from the second position to the first position. As shown in FIG. 16, in all of the first to fourth cam element sections $\mathbf{20}_1$ to $\mathbf{20}_4$, the first cam sections $\mathbf{22}_1 \ldots \mathbf{22}_1$ return to the state in which the first cam sections $\mathbf{22}_1 \ldots \mathbf{22}_1$ are located to correspond to the cam followers C', C' of the rocker arms C, C.

As explained above, according to the second embodiment, the four cam element sections $\mathbf{20}_1$ to $\mathbf{20}_4$ respectively provided in the four cylinders $\mathbf{1}_1$ to $\mathbf{1}_4$ are operated by the six operation devices $\mathbf{30}_1$ to $\mathbf{30}_6$. The cam section 22 that opens and closes the exhaust valves A . . . A is switched between the first cam sections $\mathbf{22}_1 \ldots \mathbf{22}_1$ having a large lift amount and the second cam sections $\mathbf{22}_2 \ldots \mathbf{22}_2$ having a small lift amount.

According to the second embodiment, the cam element sections $\mathbf{20}_1$ to $\mathbf{20}_4$ include the slope sections 23*c* formed over the predetermined angle range from the lift end position f of the lift sections 23*b* of the end face cams 23, with which the pin sections 32 engage, toward the rotation delay side. The slope sections 23*c* push back the pin sections 32 from the actuation position to the retracting position by coming into slide contact with the pin sections 32 after the movement by the end face cams 23 ends. Therefore, it is possible to surely push back, with the slope sections 23*c*, the pin sections 32 present in the actuation position toward the retracting position. Moreover, the slope sections 23*c* act after the movement of the cam element sections $\mathbf{20}_1$ to $\mathbf{20}_4$ by the pin section 32 ends. Therefore, it is possible to quickly push back the pin sections 32 to the retracting position while surely performing the movement of the cam element sections $\mathbf{20}_1$ to $\mathbf{20}_4$. Consequently, even when the cam is continuously switched, it is possible to instantaneously continuously perform the switching operation for the cam sections $\mathbf{22}_1$, $\mathbf{22}_2$.

Further, according to the second embodiment, in the two cam element sections adjacent to each other, the lift sections 23*b*, 23*b* of the end face cams 23, 23 opposed to each other are provided to be in different phases from each other. When the lift sections 23*b*, 23*b* are close to each other, at least a part of the lift sections 23*b*, 23*b* overlap in the axial direction. Therefore, it is possible to attain compactness in the axial direction of the cam shaft 2 and compactness of the engine.

Note that the above explanation is explanation concerning the cam shaft on the exhaust side. However, a cam shaft on the intake side can also be configured completely the same. Consequently, the action and effects explained above are obtained concerning an intake side as well.

In the embodiments, in the cam element sections $\mathbf{20}_1$ to $\mathbf{20}_4$, the lift amount of the first cam section $\mathbf{22}_1$ and the lift amount of the second cam section $\mathbf{22}_2$ are set different. However, it is also possible to provide a normal nose section in one cam section and form the entire other cam section only with a base circle without providing a nose section (set the lift amount of the nose section to zero). In this case, it is possible to stop opening and closing of a valve using the other cam section. Such valve stop operation is suitable, for example, when reduced cylinder operation is performed using low-load of the engine.

In the embodiments, the example is explained in which the present invention is applied to the four-cylinder four-valve DOHC engine. However, not only this, but the present invention is applicable to various multi-cylinder engines including at least a pair of cylinders disposed adjacent to each other and continuous in ignition order and at least a pair of cylinders disposed adjacent to each other and discontinuous in ignition order.

For example, in an in-line five-cylinder engine, when ignition order is the order of a first cylinder, a second cylinder, a fourth cylinder, a fifth cylinder, and a third cylinder, a pair of cylinders disposed adjacent to each other and continuous in ignition order is two sets of the first and second cylinders and the four and fifth cylinders. A pair of cylinders disposed adjacent to each other and discontinuous in ignition order is two sets of the second and third cylinders and the third and fourth cylinders.

Note that the present invention is not limited to those explained in the embodiments various modifications and alternations are also possible without departing from the spirit and the scope of the present invention described in claims.

Finally, the characteristic configurations disclosed in the embodiments and action and effects based on the characteristic configurations are collectively explained.

The embodiments relate to a valve system provided in a multi-cylinder engine including at least a pair of cylinders disposed adjacent to each other and discontinuous in ignition order and at least a pair of cylinders disposed adjacent to each other and continuous in ignition order. The valve system includes: a cam shaft including a shaft section extending in a cylinder row direction and a plurality of cam element sections provided respectively in the cylinders and fit in the shaft section to be capable of rotating integrally with the shaft section and moving in an axial direction; and an operation mechanism that moves the plurality of cam element sections in the axial direction with respect to the shaft section. Each of the cam element sections includes, for each one valve of the cylinders, two cam sections which include a common base circle, have differently shaped nose sections, and are adjacent to each other in the axial direction. End face cams are respectively provided at both end portions in the axial direction of each of the cam element sections. The operation mechanism includes a plurality of operation members driven by an actuator to be movable between an actuation position where the operation members rush into positions opposed to the end face cams of the plurality of cam element sections in the axial direction and a retracting position where the operation members retract from opposing positions of the end face cams, wherein the operation mechanism engages the operation members, which have moved to the actuation position, with the end face cams and moves the cam element sections in the axial direction to thereby switch the cam section that opens and closes valves of the cylinders. The plurality of operation members include: a common operation member that is provided in common between the end face cams opposed to each other of the cam element sections of two cylinders disposed adjacent to each other and continuous in ignition order and that engages with the respective end face cams when both the cam element sections are close to each other; and individual operation members that are individually provided for the end face cams opposed to each other of the cam element sections of two cylinders disposed adjacent to each other and discontinuous in ignition order and the end face cams located at opposite ends of the cylinder row and that engage with the respective end face cams.

The "cam section" includes a cam section, the shape of a nose section of which coincides with the base circle (a lift amount of which is zero).

With this configuration, a single operation member (the common operation member) is disposed in the position between two cylinders disposed to be adjacent to each other and continuous in ignition order and, when cam element sections corresponding to the two cylinders are close to each other, the operation member is rushed into between end face cams opposed to each other, whereby it is possible to move the cam element sections in the axial direction to be separated from each other. That is, the cam element sections corresponding to the cylinders disposed adjacent to each other and continuous in ignition order can be moved by the single operation member. Therefore, compared with when an operation member is provided for each of end face cams, it is possible to reduce the number of components.

Operation members (individual operation members) are provided for each of end face cams opposed to each other of cam element sections of two cylinders disposed adjacent to each other and discontinuous in ignition order and the operation members are rushed into the end face cams respectively corresponding to the operation members and engaged with the end face cams, whereby it is possible to independently move the cam element sections in the axial direction. Consequently, compared with when cam element sections corresponding to cylinders disposed adjacent to each other and discontinuous in ignition order are moved by a single operation member, it is possible to expand a period in which the operation members can be projected. As a result, even during high-speed rotation of the engine, it is possible to sufficiently secure the period in which the operation members can be projected. Therefore, it is possible to properly perform switching operation for the cam sections without increasing projection speed of the operation members by, for example, increasing the size of an actuator that drives the operation members.

In the valve system, preferably, the multi-cylinder engine is an in-line four-cylinder engine, and the ignition order is set in the order of a third cylinder, a fourth cylinder, a second cylinder, and a first cylinder.

The ignition order is not limited to the case in which ignition is started from the first cylinder and includes the case in which ignition is started from any one cylinder among the second to fourth cylinders.

With this configuration, common operation members are respectively disposed in positions between the first and second cylinders disposed adjacent to each other and continuous in ignition order and between the third and fourth cylinders and individual operation members are respectively disposed in inter-cylinder positions other than the positions and end portion positions of a cylinder row, whereby it is possible to configure the valve system with six operation members. That is, compared with when operation members are provided for each of the end face cams (in this case, eight operation members are necessary), it is possible to reduce the number of operation members.

With the disposition pattern explained above, the individual operation members are disposed for each of the opposed end face cams between the second and third cylinders disposed adjacent to each other and discontinuous in ignition order. Therefore, it is possible to expand the period in which the operation members can be projected. Therefore, even during high-speed rotation of the engine, it is possible to properly perform the switching operation for the cam sections.

In the valve system, preferably, the cam element section includes a slope section that comes into slide contact with the operation member located in the actuation position and pushes back the operation member to the retracting position after the movement of the cam element section in the axial direction by the operation member ends. The slope section corresponding to the common operation member is provided only in the cam element section that moves later in moving order of the two cam element sections to be moved in a separating direction by the common operation member.

With this configuration, the operation member present in the actuation position can be forcibly pushed back to the retracting position by the slop section provided in the cam element section after the movement of the cam element section in the axial direction by the operation member ends. That is, after the movement of the cam element section is surely performed, it is possible to surely move the operation member to the retracting position. Consequently, even when the switching operation for the cam sections is continuously performed, it is possible to surely prevent interference of the operation member and the cam element section. Therefore, it is possible to continuously perform the switching operation for the cam sections.

In particular, for the common operation member disposed between the two cylinders disposed adjacent to each other and continuous in ignition order, the slope section is provided only in the cam element section that moves later in moving order of the two cam element sections to be moved in the separating direction by the common operation member. Therefore, after both the cam element sections adjacent to each other are respectively properly moved in the separating direction, it is possible to push back the common operation member to the retracting position.

In the valve system, preferably, the cam element section includes: a slope section that comes into slide contact with the operation member located in the actuation position and pushes back the operation member to the retracting position after the movement of the cam element section in the axial direction by the operation member ends; and a regulating section that is formed to be contiguous to the slope section and regulates movement of the operation member, which has been pushed back to the retracting position, to the actuation position. The slope section and the regulating section corresponding to the common operation member are provided only in the cam element section that moves later in moving order of the two cam element sections to be moved in the separating direction by the common operation member.

With this configuration, the movement of the operation member to the actuation position can be prevented by the regulating section formed to be contiguous to the slope section. Therefore, it is possible to prevent the operation member present in the retracting position from moving to the actuation position because of, for example, a malfunction of the actuator. Consequently, it is possible to prevent interference of the operation member and the cam element section and improve robustness of the valve system.

For the common operation member disposed between the two cylinders disposed adjacent to each other and continuous in ignition order, the slope section and the regulating section are provided only in the cam element section that moves later in moving order of the two cam element sections to be moved in the separating direction by the common operation member. Therefore, after the both the cam element sections adjacent to each other are respectively properly moved in the separating direction, it is possible to properly push the common operation member to the retracting position and prevent movement of the common operation member to the actuation position.

INDUSTRIAL APPLICABILITY

As explained above, according to the present invention, in the valve system for the multi-cylinder engine, it is possible to easily perform switching operation for the cams during high-speed rotation of the engine while reducing the number of components to attain compactness of the engine. Therefore, there is possibility that the present invention is suitably used in the technical field of manufacturing of the engine of this type.

The invention claimed is:

1. A valve system provided in a multi-cylinder engine including at least a pair of cylinders disposed adjacent to each other and discontinuous in ignition order and at least a pair of cylinders disposed adjacent to each other and continuous in ignition order, the valve system comprising:

a cam shaft including a shaft section extending in a cylinder row direction and a plurality of cam element sections provided respectively in the cylinders and fit in the shaft section to be capable of rotating integrally with the shaft section and moving in an axial direction; and an operation mechanism that moves the plurality of cam element sections in the axial direction with respect to the shaft section, wherein each of the cam element sections having end portions and including, for each one valve of the cylinders, two cam sections which include a common base circle, have differently shaped nose sections and are adjacent to each other in the axial direction, end face cams are respectively provided at the end portions in the axial direction of each of the cam element sections, the operation mechanism includes a plurality of operation members driven by an actuator to be movable between an actuation position where the operation members rush into positions opposed to the end face cams of the plurality of cam element sections in the axial direction and a retracting position where the operation members retract from opposing positions of the end face cams, the operation mechanism engaging the operation members, which have moved to the actuation position, with the end face cams and moving the cam element sections in the axial direction to thereby switch the cam section that opens and closes valves of the cylinders, the plurality of operation members include:

a common operation member that is provided in common between the end face cams opposed to each other of the cam element sections of two cylinders disposed adjacent to each other and continuous in ignition order and that engages with the respective end face cams when both the cam element sections are close to each other; and individual operation members that are individually provided for the end face cams opposed to each other of the cam element sections of two cylinders disposed adjacent to each other and discontinuous in ignition order and the end face cams located at opposite ends of the cylinder row and that engage with the respective end face cams.

2. The valve system for a multi-cylinder engine according to claim 1, wherein the multi-cylinder engine is an in-line four-cylinder engine, and the ignition order is set in order of a third cylinder, a fourth cylinder, a second cylinder, and a first cylinder.

3. The valve system for a multi-cylinder engine according to claim 1, wherein the cam element section includes a slope section that comes into slide contact with the operation member located in the actuation position and pushes back the operation member to the retracting position after the movement of the cam element section in the axial direction by the operation member ends, and the slope section corresponding to the common operation member is provided only in the cam element section that moves later in moving order of the two cam element sections to be moved in a separating direction by the common operation member.

4. The valve system for a multi-cylinder engine according to claim 1, wherein the cam element section includes: a slope section that comes into slide contact with the operation member located in the actuation position and pushes back the operation member to the retracting position after the movement of the cam element section in the axial direction by the operation member ends; and a regulating section that is formed to be contiguous to the slope section and regulates movement of the operation member, which has been pushed back to the retracting position, to the actuation position, and the slope section and the regulating section corresponding to the common operation member are provided only in the cam element section that moves later in moving order of the two cam element sections to be moved in a separating direction by the common operation member.

* * * * *